US011512523B2

(12) United States Patent
Dawdy

(10) Patent No.: US 11,512,523 B2
(45) Date of Patent: Nov. 29, 2022

(54) FIRE RATED DOOR

(71) Applicant: CORNELLCOOKSON, LLC, Mountain Top, PA (US)

(72) Inventor: David Dawdy, Mountain Top, PA (US)

(73) Assignee: CORNELLCOOKSON, LLC, Mountain Top, PA (US)

( * ) Notice: Subject to any disclaimer, the term of this patent is extended or adjusted under 35 U.S.C. 154(b) by 289 days.

(21) Appl. No.: 16/499,102

(22) PCT Filed: Mar. 27, 2018

(86) PCT No.: PCT/US2018/024584
§ 371 (c)(1),
(2) Date: Sep. 27, 2019

(87) PCT Pub. No.: WO2018/183339
PCT Pub. Date: Oct. 4, 2018

(65) Prior Publication Data

US 2021/0087874 A1 Mar. 25, 2021

Related U.S. Application Data

(60) Provisional application No. 62/477,189, filed on Mar. 27, 2017.

(51) Int. Cl.
*E06B 5/16* (2006.01)
*A62C 2/06* (2006.01)
(Continued)

(52) U.S. Cl.
CPC ..... *E06B 5/164* (2013.01); *A62C 2/065* (2013.01); *E05Y 2900/134* (2013.01); *E06B 9/15* (2013.01);
(Continued)

(58) Field of Classification Search
CPC . E06B 5/16; E06B 5/161; E06B 5/162; E06B 5/164; E06B 9/15; E06B 9/17076;
(Continued)

(56) References Cited

U.S. PATENT DOCUMENTS 935,125 A 9/1909 McCloud
978,770 A 12/1910 McCloud
(Continued)

FOREIGN PATENT DOCUMENTS

CN 203248029 U 10/2013
CN 104775737 B 6/2016
(Continued)

OTHER PUBLICATIONS

International Search Report dated Jul. 23, 2018 of International Patent Application No. PCT/US2018/024584, 4 pages.
(Continued)

*Primary Examiner* — William V Gilbert
(74) *Attorney, Agent, or Firm* — Tong, Rea, Bentley & Kim, LLC

(57) ABSTRACT

A closure may include a door configured to seal an opening. The door may include a section with an internal cavity. The closure may also include a core within a first portion of the internal cavity of the section. The core may be configured to expand from a relaxed state to an expanded state and provide a seal between the door and an edge of the opening when the core is in the expanded state.

25 Claims, 21 Drawing Sheets

(51) Int. Cl.
*E06B 9/15* (2006.01)
*E06B 9/58* (2006.01)

(52) U.S. Cl.
CPC ..... *E06B 2009/1583* (2013.01); *E06B 2009/1594* (2013.01); *E06B 2009/588* (2013.01)

(58) Field of Classification Search
CPC ..... E06B 2009/1594; E06B 2009/588; A62C 2/06; A62C 2/065; E05Y 2900/134
USPC ..... 52/1, 232, 784.11, 784.14
See application file for complete search history.

(56) References Cited

U.S. PATENT DOCUMENTS

| | | | | |
|---|---|---|---|---|
| 978,771 | A | 12/1910 | McCloud | |
| 1,015,332 | A | 1/1912 | McCloud | |
| 1,101,865 | A | 6/1914 | McCloud | |
| 1,658,513 | A | 2/1928 | Bumbarger | |
| 1,784,841 | A | 12/1930 | Bernhard | |
| 2,564,208 | A | 8/1951 | Nathan | |
| 3,685,567 | A | 8/1972 | Pemberton et al. | |
| 4,015,386 | A * | 4/1977 | Cook | E04B 1/942 52/232 |
| 4,144,688 | A | 3/1979 | Dixon | |
| 4,747,197 | A | 5/1988 | Charron et al. | |
| 4,888,057 | A | 12/1989 | Nguyen | |
| 5,022,452 | A | 6/1991 | Burrell | |
| 5,245,879 | A | 9/1993 | McKeon | |
| 5,305,901 | A | 4/1994 | Dennig | |
| 5,355,927 | A | 10/1994 | McKeon | |
| 5,373,932 | A | 12/1994 | Stobich et al. | |
| 5,440,843 | A | 8/1995 | Langenhorst | |
| 5,542,460 | A | 8/1996 | McKeon | |
| 5,605,185 | A | 2/1997 | McKeon | |
| 5,673,514 | A | 10/1997 | McKeon | |
| 5,743,320 | A | 4/1998 | McKeon | |
| 5,782,690 | A | 7/1998 | Gustafson et al. | |
| 5,893,234 | A | 4/1999 | McKeon | |
| 6,521,834 | B1 | 2/2003 | Dykhoff et al. | |
| 6,615,894 | B1 | 9/2003 | McKeon | |
| 6,745,526 | B1 * | 6/2004 | Autovino | E06B 3/74 52/232 |
| 6,752,714 | B1 | 6/2004 | Mann et al. | |
| 8,080,962 | B2 | 12/2011 | Cooper et al. | |
| 8,109,316 | B2 | 2/2012 | Wang | |
| 8,251,118 | B2 | 8/2012 | Loar | |
| 8,307,877 | B1 | 11/2012 | Lambridis et al. | |
| 8,443,909 | B2 | 5/2013 | Wong | |
| 8,517,809 | B2 | 8/2013 | Wexler | |
| 8,789,576 | B2 | 7/2014 | Krueger et al. | |
| 8,800,632 | B2 | 8/2014 | Cooper et al. | |
| 8,816,843 | B2 | 8/2014 | Cooper et al. | |
| 9,127,501 | B1 | 9/2015 | Stobich et al. | |
| 9,746,289 | B2 * | 8/2017 | Hahn | F41H 5/045 |
| 10,920,417 | B2 * | 2/2021 | Hulteen | E04B 1/948 |
| 2006/0248833 | A1 | 11/2006 | Autovino et al. | |
| 2007/0277458 | A1 | 12/2007 | Graboyes | |
| 2009/0008039 | A1 | 1/2009 | Lambridis | |
| 2009/0211163 | A1 | 8/2009 | Smith | |
| 2011/0016796 | A1 | 1/2011 | Foster | |
| 2011/0314755 | A1 | 12/2011 | Langille et al. | |
| 2013/0104470 | A1 | 5/2013 | Mueller | |
| 2013/0255893 | A1 | 10/2013 | Stobich et al. | |
| 2013/0306252 | A1 | 11/2013 | Lambridis | |
| 2014/0190709 | A1 | 7/2014 | Stoebich et al. | |
| 2015/0135596 | A1 | 5/2015 | Cooper | |
| 2015/0231427 | A1 | 8/2015 | Coopers | |
| 2016/0024785 | A1 | 1/2016 | Stobich et al. | |

FOREIGN PATENT DOCUMENTS

| | | | |
|---|---|---|---|
| EP | 1491712 | B1 | 8/2014 |
| EP | 2158007 | B1 | 12/2014 |
| EP | 2520337 | B1 | 1/2015 |
| EP | 2939712 | A1 | 11/2015 |
| EP | 2939713 | A2 | 11/2015 |
| EP | 2982418 | A1 | 2/2016 |
| JP | 2006283382 | A | 10/2006 |
| WO | 2014045009 | A3 | 3/2014 |
| WO | 2014135863 | A1 | 3/2014 |
| WO | 2014199126 | A1 | 12/2014 |
| WO | 2015033149 | A2 | 3/2015 |
| WO | 2015055990 | A2 | 4/2015 |
| WO | 2015055993 | A1 | 4/2015 |
| WO | 2015118315 | A2 | 8/2015 |

OTHER PUBLICATIONS

Written Opinion dated Jul. 23, 2019 of International Patent Application No. PCT/US2018/024584, 16 pages.
"Basic Fire Door, Fire Door Frame, Transom/Sidelight Frame, and Window Frame Requirements", Steel Door Institute (SDI) 118-19, Mar. 5, 2017, 12 pages.

* cited by examiner

FIRE RATED DOOR

CROSS REFERENCE TO RELATED APPLICATIONS

The present application is a U.S. National Phase Application under 35 U.S.C. 371 of International Application No. PCT/US2018/024584 filed Mar. 27, 2018, which claims the benefit of U.S. Provisional Patent Application No. 62/477,189 filed Mar. 27, 2017 entitled "Fire Rated Door", which are hereby incorporated by reference in their entirety.

BACKGROUND OF THE INVENTION

The present invention generally relates to a closure for an opening and, more particularly, to a door configured to provide a protective barrier to heat, air, smoke, and/or fire.

Fire protection in structures can involve providing a protective barrier to enclose an area thereby impeding the progress of the fire. A portion of the barrier may be a part of the building such as walls or hallways that include doorways to allow people to traverse through the structure. Typically, the weakest points of a fire barrier are the doors and doorways connecting the hallways. Fire doors are constructed to provide a barrier to heat, air, smoke, and/or fire for a selected length of time at certain temperatures.

Existing fire doors may be constructed of fire proof materials such as steel, aluminum, fiberglass, or other heat resistant materials. In some instances, fire resistance of the door is increased by increasing the thickness of the door. However, increasing the thickness of a door may be impractical in tight spaces were a sufficiently thick door may not fit in the existing space. Furthermore, cracks between the door and doorway create a passageway that allows heat, air, smoke, and/or fire to pass through. Doors having a significant thickness may also be heavy and impair storage in an overhead configuration. Such doors may also not be aesthetically pleasing.

Furthermore, it is difficult to provide fire protection to comply with building codes in open areas such as an atrium or auditorium because there are no existing hallways or existing fire barriers. Thus, an improved fire protection door and system are desirable.

BRIEF SUMMARY OF THE INVENTION

In one embodiment there is a closure comprising a door configured to seal an opening, the door including a section with an internal cavity. The closure may include a core within a first portion of the internal cavity of the section, the core configured to expand from a relaxed state to an expanded state and provide a seal between the door and an edge of the opening when the core is in the expanded state. The door may comprise a slat that includes the section. In a further embodiment, a guide may be coupled to the edge of the opening and configured to receive a first portion of the section. The door may be moveable with respect to the opening along the guide from a retracted position to an extended position and the first portion of the section is adjacent the guide when the door is in the extended position. In a further embodiment, the closure may comprise a steady-state core in a second portion of the internal cavity of the section, the second portion spaced from the guide. The steady-state core may be non-combustible.

In a further embodiment, the closure may include a seal along the guide configured to seal a guide space when the door is in the extended position. The seal may be configured to provide a barrier to heat, air, smoke, and/or fire throughout an expansion of the core from the relaxed state to the expanded state. In a further embodiment, the closure may comprise a bottom seal on a bottom of the door configured to provide a seal between the bottom of the door and a bottom of the opening when the door is in the extended position to at least a temperature of about 400° F. In a further embodiment, a siliconized rubber perimeter seal may be configured to restrict infiltration of heat, air, smoke, and/or fire migration at least until the core is in the expanded state under conditions that causes the core to expand. The siliconized rubber perimeter seal may be configured to restrict infiltration of heat, air, smoke, and/or fire migration to a level of about 600° F.

In a further embodiment, an opening header may be configured to receive the door when the door is in the retracted position; and the section may be adjacent the opening header when the door is in the extended position and the core may be configured to seal a header space between the door and the opening header when the core is in the expanded state. The section may include a perforation such that the core expands through the perforation and into the header space, thereby forming a seal with the opening header. The core may be configured to expand in response to an increase in temperature. The door may be configured to provide a seal to heat, air, smoke, and/or fire up to at least 400° F. The door may be configured to provide a seal to heat, air, smoke, and/or fire up to at least 2000° F. The section may include a section thickness and the core may be configured to expand to at least 500% of the section thickness. The door may comprise a coiling door. The door may include a plurality of additional sections, each of the additional sections having front perforations and back perforations that are configured to permit the core to migrate through the front perforations and the back perforations when the core transitions to the expanded state.

In a further embodiment, a second section may be adjacent to and interlock with the section with a second internal cavity and a second core within a first portion of the second internal cavity of the second section, the second core configured to expand from a relaxed state to an expanded state and provide a seal between the door and an edge of the opening when the core is in the expanded state. The second section and the first section may interlock in a front to back hinged configuration. The core may comprise first and second expanding portions disposed on opposite sides of a backing material, the first and second expanding portions aligned with a front portion of the section and a back portion of the section respectively. In a further embodiment, the closure may include a perimeter seal along the guide and the opening header configured as a barrier to heat, air, smoke, and/or fire at a temperature at which the core transitions to the expanded state. The core may be configured to initiate expansion when it reaches about 360° F.

One embodiment of a closure may comprise a door configured to seal an opening, the door including a section with an internal cavity and a perforation extending between the internal cavity and a first surface of the section; and a core within the internal cavity of the section, the core configured to expand from a relaxed state to an expanded state such that the core extends through the perforation and onto the first surface of the section when the core is in the expanded state. In a further embodiment, the closure may include a guide coupled to an edge of the opening. The door may be moveable with respect to the opening along the guide from a retracted position and to an extended position.

The core may be configured to form a seal between the section and the guide when the core is in the expanded state.

In a further embodiment, the closure may include an opening header configured to receive the door when the door is in the retracted position. A header space may be between the door and the opening header when the door is in the extended position. The section may be adjacent the opening header when the door is in the extended position and the perforation confronts the header space such that the core provides a seal between the door and the opening header when the core is in the expanded state.

In a further embodiment, the closure may include a bottom seal on a bottom of the door configured to provide a seal with a bottom of the opening to a temperature of about 450° F. In a further embodiment, the closure may comprise a siliconized rubber perimeter seal configured to restrict infiltration of heat, air, smoke, and/or fire migration up to a level of about 600° F. In a further embodiment, the closure may comprise a seal along the guide configured to provide a seal throughout an expansion of the core from the relaxed state to the expanded state. The core may be configured to expand in response to an increase in temperature. The door may be configured to provide a seal to heat, air, smoke, and/or fire up to about 450° F. The door may be configured to provide a seal to heat, air, smoke, and/or fire up to about 450° F. above an ambient temperature. The door may be configured to provide a seal to heat, air, smoke, and/or fire up to about 450° F. above an ambient temperature at a 30-minute mark on a standard underwriter's laboratories time-temperature curve. The section may include a section thickness and the core is configured to expand to about 500% of the section thickness.

One embodiment of a closure may include a door configured to seal an opening, the door including a section with an internal cavity, the section having a first surface with a first perforation in conduit with the internal cavity and a second surface with a second perforation connected to the internal cavity. A core may be within the internal cavity of the section, the core expandable from a relaxed state to an expanded state such that the core is configured to expand through the first perforation and the second perforation thereby forming a first layer on the first surface of the section and a second layer on the second surface of the section when the core is in the expanded state.

In a further embodiment, the door may include a divider between the first surface and the second surface which separates the internal cavity into a first cavity portion and a second cavity portion. The first cavity portion and the second cavity portion may be isolated from each other. The divider may be coupled to at least one of the first surface and the second surface. The divider may comprise a floating divider and is not fixed to either of the first surface and the second surface. The core may include a first core portion in the first cavity portion and a second core portion in the second cavity portion. The first core portion may confront the first surface of the section and the second core portion may confront the second surface of the section.

In a further embodiment, the closure may include a guide coupled to an edge of the opening. The door may be moveable with respect to the opening along the guide from a retracted position to an extended position. The core may be configured to create a seal between the section and the guide when the core is in the expanded state. In a further embodiment, the closure may include an opening header configured to receive the door when the door is in the retracted position and a header space between the door and the opening header when the door is in the extended position. The core may be configured to seal the header space when the core is in the expanded state. In a further embodiment, the closure may include a bottom seal on a bottom of the door configured to provide a seal with a bottom of the opening to at least a temperature of 400° F. In a further embodiment, the closure may include a siliconized rubber perimeter seal configured to restrict infiltration of heat, air, smoke, and/or fire migration to a level of about 650° F. The siliconized rubber perimeter seal may be configured to restrict infiltration of heat, air, smoke, and/or fire migration at least until the core is in the expanded state under conditions that cause the core to expand.

In a further embodiment, the closure may include a perimeter seal along the guide and the opening header configured to provide a seal between the door and each of the guide and the opening header during an expansion of the core. The section may include a section thickness and the core may be configured to expand to about 500% of the section thickness. The door may be configured to withstand temperatures up to about 2000° F. The door may be configured to undergo a maximum temperature rise of 250° F. over an ambient temperature on one of the first surface and the second surface when the other of the first surface and the second surface are exposed to an increased temperature.

BRIEF DESCRIPTION OF THE SEVERAL VIEWS OF THE DRAWINGS

The foregoing summary, as well as the following detailed description of embodiments of the closure, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

A closure may be configured to seal an opening to restrict infiltration of heat, air, smoke, and/or fire migration through the opening. In some embodiments, the closure includes a door configured to expand in response to environmental conditions. For example, the door may expand when one or more surfaces of the door are exposed to a sufficiently elevated temperature. In one embodiment, the door is configured to form a seal around the perimeter of the opening when the door moves to the expanded state.

In one embodiment, a closure includes an expandable material that at least partially seals a space between the closure and a doorway to prevent unwanted migration of heat, air, smoke, and/or fire. In one embodiment, the expandable material is configured to expand when exposed to a selected temperature. For example, the expandable material may expand when one side of the closure is exposed to a preselected temperature (e.g., about 165° F., about 360° F.). In one embodiment, the expandable material may expand when one side of the closure is exposed to a temperature of about 360° F. for a preselected time period. In one embodiment, a closure is configured to introduce intumescent material into the end cavity or hollow space created in a section of a door such that when a fire event creates a certain elevated temperature, the intumescent material expands, filling the gaps between the door and the guides, creating a protective barrier to heat, air, smoke, and/or fire that maintains a seal at temperatures higher than the 400° F. required by UL 1784. A seal may be completely imperviousness to heat, air, smoke, and/or fire; but a seal could also be a means to prevent unwanted migration of heat, air, smoke, and/or fire through the seal.

Figure 1:
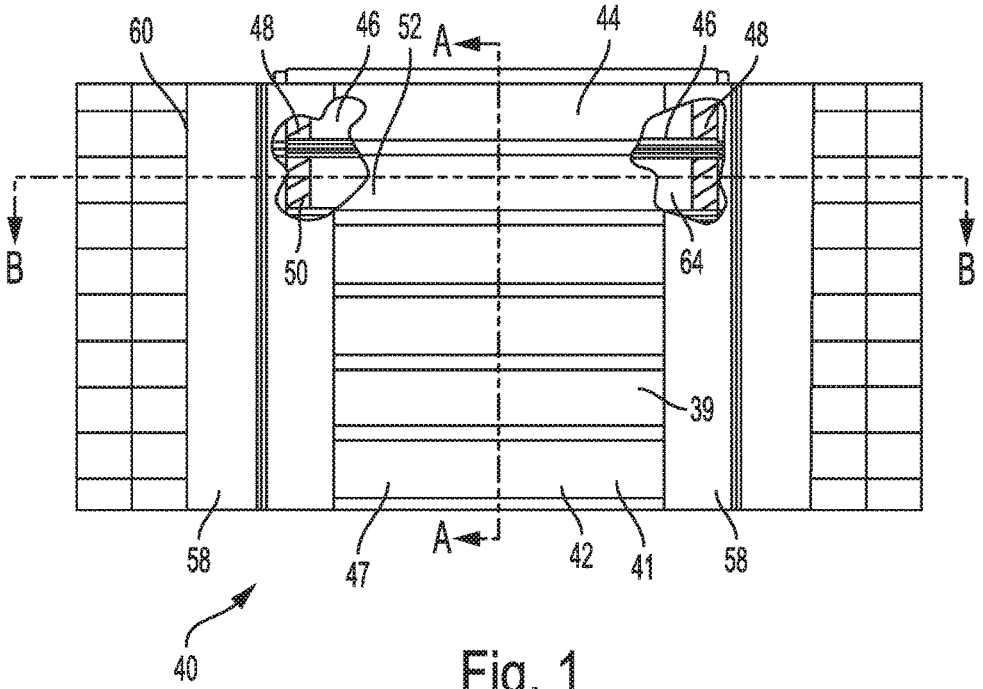
FIG. 1 is a front view of a closure in accordance with an exemplary embodiment of the present invention.

Referring to the drawings in detail, wherein like reference numerals indicate like elements throughout, there is shown in FIGS. 1-13 a closure, generally designated 40, in accordance with an exemplary embodiment of the present invention. In one embodiment, the closure 40 includes a door 42 to seal an opening (e.g., a window, door, roof opening, accessway) as shown in FIG. 1. In one embodiment, the door 42 is moveable from a retracted state (FIG. 4) to allow passage through the opening; to an extended state (FIG. 1) where the door prevents at least some degree of passage through the opening. In one embodiment, the door is configured to provide a seal to heat, air, smoke, and/or fire when the environment surrounding or at least on one side of the door reaches a temperature of at least 400° F. In one embodiment, the door is configured to provide a seal to heat, air, smoke, and/or fire up to at least 2000° F.

In one embodiment, the door 42 includes one or more sections 44. In one embodiment, section 44 includes a slat. In one embodiment, door 42 includes a plurality of sections 44 configured to be coupled together by a connector 43 (e.g., a hinge, axle). The connector 43 may be configured to allow sections 44 (e.g., adjoining sections) to move relative to each other (e.g., rotate, slide, translate). In one embodiment, the sections 44 are coupled to each other by the connector 43 that is configured to permit or cause the door 42 to be coiled about itself when door 42 is in the retracted position, as explained in greater detail below. In one embodiment, the door 42 includes a plurality of sections 44 that includes first section 39 and second section 41. Second section 41, in one embodiment is adjacent to and is configured to interlock with first section 39, as explained in greater detail below. In one embodiment, the second section 41 and the first section 39 are configured to interlock in, for example, a front to back hinged configuration (best seen in FIG. 27).

In one embodiment, the door 42 includes a plurality of equally sized sections 44. In one embodiment, the door 42 includes a plurality of sections 44 having substantially identical outer dimensions (e.g., length, width, and height). In one embodiment, at least one of the plurality of sections 44 includes a different material than another of the plurality of sections. In one embodiment, the door 42 includes a plurality of sections 44, at least one of the sections being a different size or shape than another of the plurality of sections.

Figure 7:
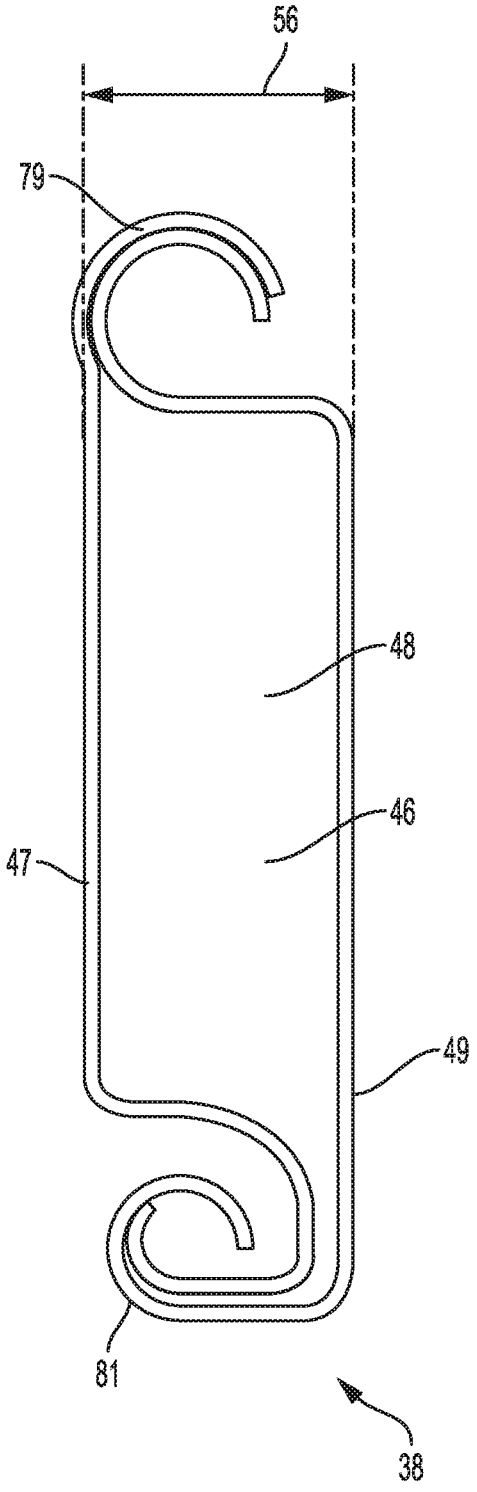
FIG. 7 is an isolated side view of a section of the closure of FIG. 1.

In the embodiment illustrated in FIG. 7, there is shown an exemplary slat assembly 38 of one section 44 that includes first surface 47 and second surface 49. In the illustrated slat assembly 38, features of first surface 47 are configured to mate with features of second surface 49, an example of which is described in more detail below. Assembly 38 may include a cap 79 and a boot 81. In one embodiment, cap 70 and boot 81 of adjoining assemblies 38 are configured to be slidingly engagable with one another (e.g., such that when engaged, the adjoining assemblies are slidable and/or rotatable with respect to each other without becoming disengaged).

In one embodiment, the first surface 47 and second surface 49 are opposing surfaces of section 44. In one embodiment, the first surface 47 and second surface 49 each include a heat resistant material (e.g., steel, aluminum). In one embodiment, section 44 includes an internal cavity 46 that is defined at least in part by the space between the first surface 47 and the second surface 49 (see, e.g., FIG. 7.)

Figure 5:
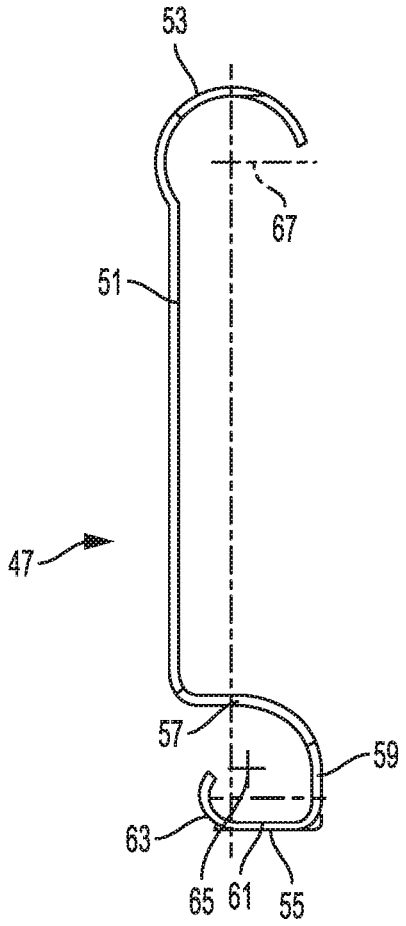
FIG. 5 is a side view of a first surface of the closure of FIG. 1.

In one embodiment, the first surface 47 has a first wall 51 with a first cap 53 and a first boot 55 (FIG. 5). In one embodiment, the first cap 53 is configured to slidingly receive a boot 81 of an adjacent section. For example, in one embodiment, when first cap 53 is received within boot 81 of an adjoining section, the two adjoining sections may be free to laterally slide relative to one another while first cap 53 and boot 81 remain in engagement. For example, in one embodiment, when first cap 53 is received within boot 81 of an adjoining section, the two adjoining sections may be free to rotate to at least some degree relative to one another while first cap 53 and boot 81 remain in engagement. In one embodiment, the first cap 53 includes an arcuate segment of a circle having a radius of about 0.15 inches to about 0.4 inches. In one embodiment, the first cap 53 has an arcuate length of about 0.5 inches to about 0.75 inches.

In one embodiment, the first boot 55 includes a first leg 57, a second leg 59, and a third leg 61 (FIG. 5). In one embodiment, first leg 57 extends away from the first wall 51 at an angle of about 75° to about 105°. In one embodiment, the first leg 57 is obtuse to the first wall 51. In one embodiment, the first leg 57 is perpendicular to the first wall 51. In one embodiment, the transition from the first wall 51 to the first leg 57 is a fillet having a radius of about 0.05 inches to about 0.11 inches. In one embodiment, the second leg 59 extends away from the first leg 57 at an angle of about 75° to about 105°. In one embodiment, the second leg 59 is parallel to the first wall 51. In one embodiment, the second leg 59 is perpendicular to the first leg 57. In one embodiment, the second leg 59 is transverse to the first leg 57. In one embodiment, the transition from the second leg 59 to the first leg 57 is a fillet having a radius of curvature of about 0.25 inches to about 0.5 inches. In one embodiment, the third leg 61 extends away from the second leg 59 at an angle of about 75° to about 105°. In one embodiment, the third leg 61 is parallel to the first leg 57. In one embodiment, the third leg 61 is perpendicular to the second leg 59. In one embodiment, the third leg 61 is transverse to the second leg 59. In one embodiment, the transition from the third leg 61 to the second leg 59 is a fillet having a radius of curvature of about 0.075 inches to about 0.175 inches. In one embodiment, a first lip 63 is coupled to an end of the third leg 61. In one embodiment, the lip 63 includes a segment of a circle having a radius of about 0.14 inches to about 0.18 inches. In one embodiment, the lip 63 has an arcuate length of about 0.25 inches to about 0.75 inches. In one embodiment, the lip 63 has a center 65 co-axial with a center 67 of the cap 53. In one embodiment, the lip 63 is configured to be slidingly received by a cap of an adjacent section (e.g., such that when received, the adjoining sections are slidable and/or rotatable with respect to each other without becoming disengaged).

Figure 6:
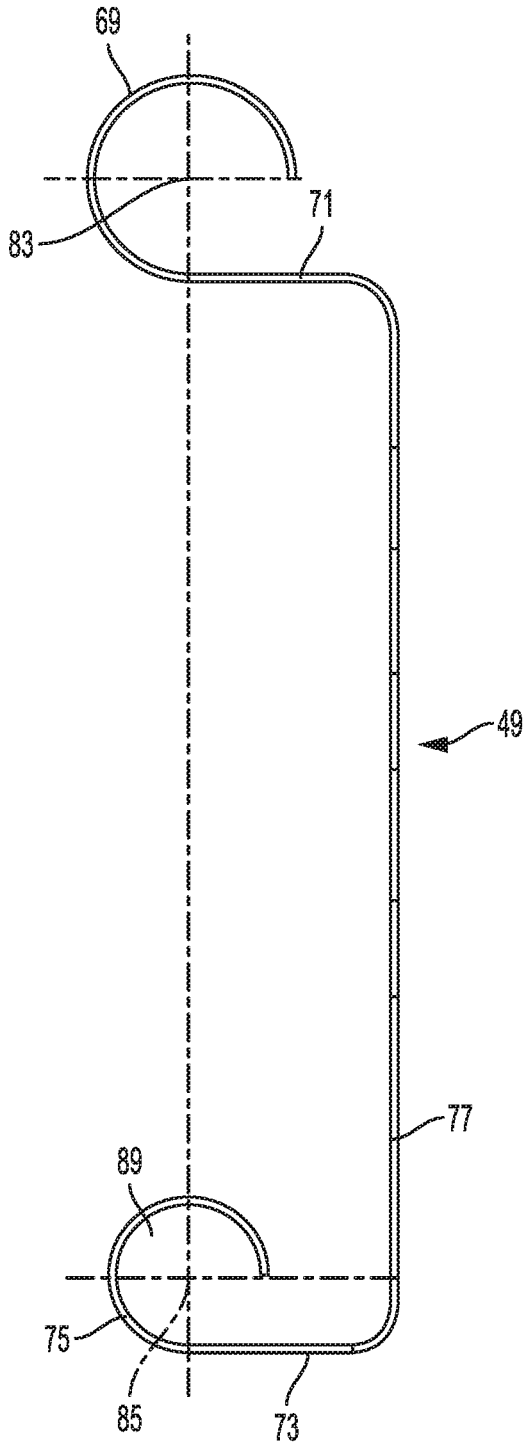
FIG. 6 is a side view of a second surface of the closure of FIG. 1.

In one embodiment, second surface 49 includes a second wall 77 with a second cap 69 and a second boot 75 (FIG. 6). In one embodiment, the second cap 69 and second boot 75 are configured to engage the first cap 53 and first boot 55, respectively, to couple the first surface 47 to the second surface 49. In one embodiment, a ratio of the length of the second wall 49 to a length of the first wall 47 is about 0.9 to about 1.1. In one embodiment, a first extension 71 is configured to connect the second cap 69 to the second wall 68. In one embodiment, the first extension 71 is perpendicular to the second wall 49. In one embodiment, the first extension 71 is transverse to the second wall 49. In one embodiment, the transition between the first extension 71 and the second wall 49 is a fillet having a radius of about 0.1 inches to about 0.15 inches. In one embodiment, the second cap 69 comprises an arcuate segment of a circle having a radius of about 0.25 inches to about 0.35 inches. In one embodiment, the second cap 69 has an arcuate length of about 0.25 inches to about 0.5 inches.

In one embodiment, second surface 49 includes a second extension 73 configured to connect the second boot 75 to the second wall 49. In one embodiment, the length of the first extension 71 and the length of the second extension 73 define the length of the internal cavity 46 (FIG. 7). In one embodiment, the transition from the second wall 49 to the second extension 73 is a fillet having a radius of about 0.1 inches to about 0.15 inches. In one embodiment, the second boot 75 includes an arcuate portion of a circle having a radius of about 0.2 inches to about 0.25 inches. In one embodiment, the second boot 75 has an arcuate length of about 0.25 inches to about 0.75 inches. In one embodiment, a receiving area 89 configured to receive the first boot is defined by the arcuate portion of the second boot 75. In one embodiment, the center 83 of the second cap 69 is co-axial with the center 85 of the second boot.

Figure 8:
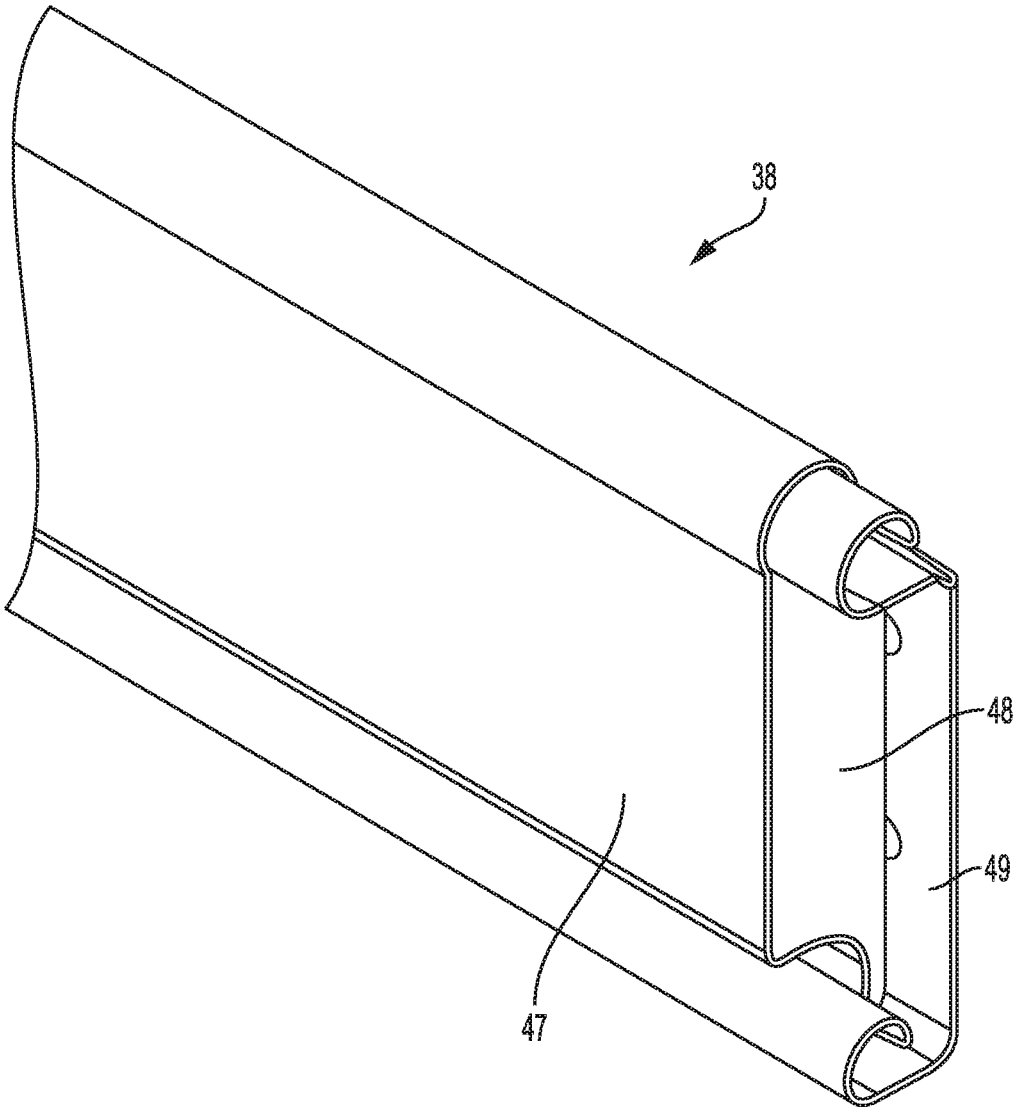
FIG. 8 is a perspective view of the section of FIG. 7.
Figure 27:
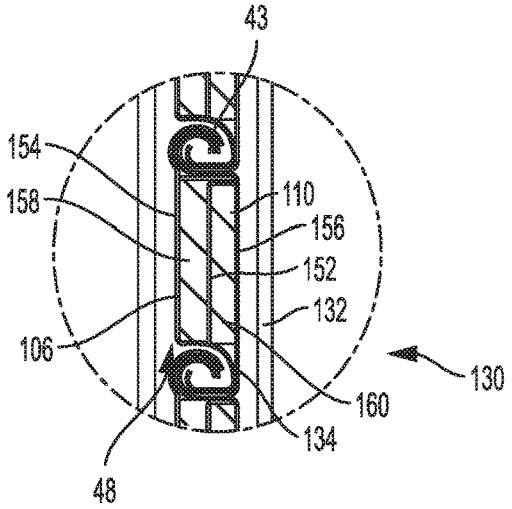
FIG. 27 is a close up detail view of the closure of FIG. 24.
Figure 28:
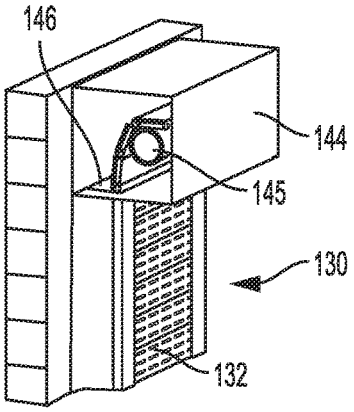
FIG. 28 is a top, side perspective view of the closure of FIG. 23.

In one embodiment, the cap 79 includes the first cap 53 and second cap 69 (FIGS. 7-8). In one embodiment, the first cap 53 is configured to be coupled to the second cap 69. For example, in one embodiment, the second cap 69 may be nested within the first cap 53 (FIG. 7). In one embodiment, the second cap 69 may be fixed to the first cap 53 by a snap-fit between the first cap 53 and second cap 69. In one embodiment, the first cap 53 is coupled to the second cap 69 by adhesive, welding, etc. In one embodiment, the slat assembly 38 includes a boot 81 including the first boot 55 and second boot 75. In one embodiment, the second boot 75 is configured to receive the first boot 55 (FIG. 7). For example, the first boot 55 may be positioned within the receiving area 89 of the second boot 75 to couple the first boot 55 to the second boot 75. In one embodiment, the first boot 55 may be slightly larger (e.g., greater in length) than the receiving area 89 such that there is a slight interference fit between the first boot 55 and second boot 75 when the first boot is within the receiving area 89. In one embodiment, the second boot 75 at least partially surrounds the first boot 55. In one embodiment, the door 42 includes a plurality of sections 44 and the cap 79 of a first section 44 is configured to receive the boot 81 of a second section (FIG. 27). For example, the boot 81 of a second section may be nested within the cap 79 of a first section (e.g., such that when nested, the adjoining sections are slidable and/or rotatable with respect to each other without the boot and cap becoming disengaged). In one embodiment, the door 42 is configured to coil about itself when the door is in the retracted position. For example, the door 42 may be in a spiral configuration with the sections 44 at least slightly rotated relative to adjoining sections and sequentially nesting around a central axis (e.g., a pipe or shaft).

In one embodiment, the section 44 is configured to include the internal cavity 46 (FIG. 7) between the first surface 47 and the second surface 49 of the section 44. In one embodiment, the internal cavity 46 is configured to receive at least one of a core 48 and a second core 64. For example, the internal cavity 46 may be a void between the first surface 47 and second surface 49 and the core 48 or second core 64 may be positioned in the void. In one embodiment, the volume of the internal cavity 46 is about 60% to about 100% of the total volume of the section 44. In one embodiment, the closure comprises a plurality of sections 44 and the internal cavity 46 of each section 44 has an equal (or substantially equal) volume. In one embodiment, the volume of the internal cavity 46 of one section is different than the volume of the internal cavity of another section 44.

Figure 3:
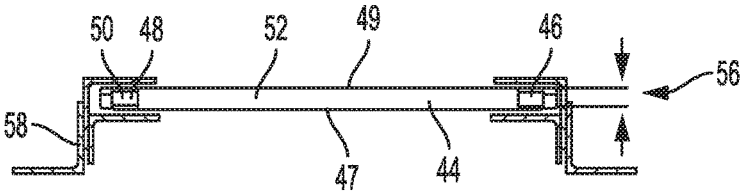
FIG. 3 is a top sectional view of the closure of FIG. 1 along line B-B.
Figure 4:
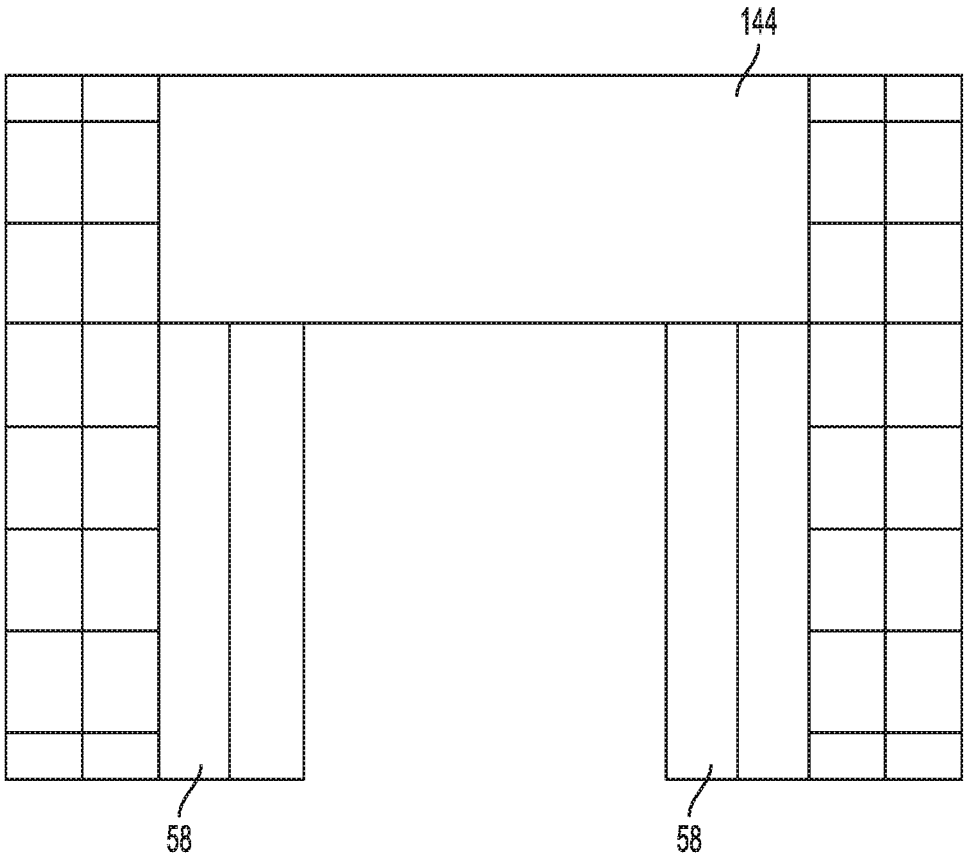
FIG. 4 is a front view of the closure of FIG. 1 in a retracted position.

In one embodiment, the expandable core is configured to expand to form a seal between the section 44 and a guide connected to a sidewall of an opening (e.g., doorway), as explained in greater detail below. For example, a first portion 50 of the internal cavity 46 may include the expandable core and be positioned at or near an edge of the section 44 such that the core expands into contact with the guide when the core is in the expanded state. In one embodiment, the internal cavity 46 includes a first portion 50 configured to receive the core 48 and a second portion 52 configured to receive a steady state core (FIG. 3). In one embodiment, the internal cavity 46 includes a divider (not shown) at least partially separating the first portion 50 from the second portion 52. In one embodiment, there is no physical barrier between the first portion 50 and the second portion 52 and the first portion/second portion distinction is made to reference the portion of the internal cavity occupied by the expandable core and the portion occupied by the steady state core.

In one embodiment, each of the first portion 50 and the second portion 52 contain a material. In one embodiment, the first portion 50 contains a material and the second portion 52 is empty. In one embodiment, the first portion 50 is configured to be positioned at an edge of the section 44 and the second portion 52 is configured to be between the edges of the section 44. In one embodiment, each section 44 comprises a plurality of independent internal cavities 46 separated by a divider (not shown). For example, in some embodiments the internal cavity 46 may not extend the entire length of the section 44 and instead only be positioned at selected locations in the section 44 while the remainder of the section comprises a solid or semi-solid structure wherein the first surface 47 abuts the second surface 49. In one embodiment, the door 42 comprises a plurality of sections 44 and only some of the sections include the first portion 50 with the core 48 therein. In one embodiment, the internal cavity 46 is formed only at the ends of the section 44. In one embodiment, the first portion 50 includes an open end. For example, the core 48 may migrate from the first portion 50 out of the first portion through the open end when the core 48 moves from the relaxed state to the expanded state.

In one embodiment, the door 42 includes the second section 41 with a second internal cavity and a second core within a first portion 50 of the second internal cavity of the second section. In one embodiment, the second core is configured to expand from a relaxed state to an expanded state and provide a seal between the door and an edge of the opening when the second core is in the expanded state.

In one embodiment, the first portion 50 is configured to have a volume equal to about 10% of the total volume of the section 44. In one embodiment, the first portion 50 is configured to have a volume equal to about 20% of the total volume of the section 44. In one embodiment, the first portion 50 is configured to have a volume equal to about 30% of the total volume of the section 44. In one embodiment, the first portion 50 is configured to have a volume equal to about 40% of the total volume of the section 44. In one embodiment, the first portion 50 is configured to have a volume equal to about 50% of the total volume of the section 44. In one embodiment, the first portion 50 is configured to have a volume equal to about 60% of the total volume of the section 44. In one embodiment, the first portion 50 is configured to have a volume equal to about 70% of the total volume of the section 44. In one embodiment, the first portion 50 is configured to have a volume equal to about 80% of the total volume of the section 44. In one embodiment, the door 42 comprises a plurality of sections 44 and at least one of the sections has a ratio of a first portion 50 volume to total section volume different than the ratio of another of the plurality of sections.

Figure 14:
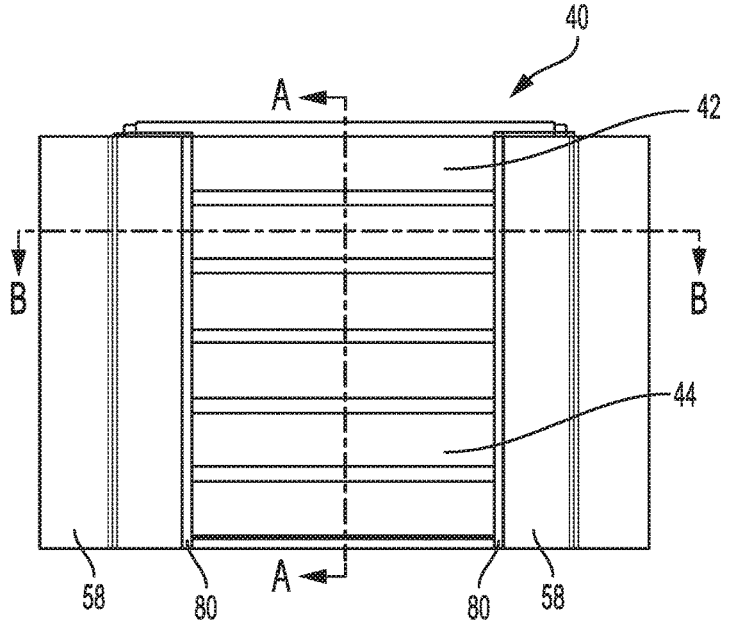
FIG. 14 is a front view of the closure of FIG. 1 with the core in an expanded state.
Figure 15:
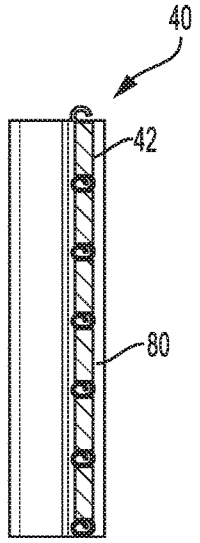
FIG. 15 is a side sectional view of the closure of FIG. 1 with the core in an expanded state.
Figure 16:
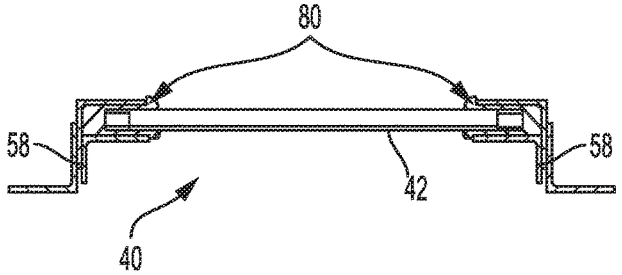
FIG. 16 is a top view of the closure of FIG. 1 with the core in an expanded state.

In one embodiment, the internal cavity 46 includes a core 48 configured to expand from a relaxed state (FIGS. 1-3) to an expanded state (FIGS. 14-16). In one embodiment, core 48 is configured to seal a space between the door and a guide when the core 48 is in the expanded state. In one embodiment, the core 48 is disposed within the first portion 50 of the internal cavity 46. In one embodiment, the core 48 is configured to have a volume equal to about 5% to about 20% of the volume of the first portion 50 of the internal cavity 46 when the core is in the relaxed state. In one embodiment, the core 48 is configured to have a volume equal to about 5% to about 20% of the total volume of the internal cavity 46 when the core is in the relaxed state.

In one embodiment, the section 44 includes a section thickness 56. For example, the section thickness 56 may be defined by the distance between outer edges of the first surface 47 and second surface 49 (see, e.g., FIGS. 3 and 7). Core 48 is expandable in some embodiments to at least 500% of the section thickness 56 when the core 48 is in the expanded state. In one embodiment, the core 48 occupies about 5% to about 20% of the volume of the internal cavity 46 when the core 48 is in the relaxed state and expands to about 20 times to about 40 times the section thickness 56 when the core 48 is in the expanded state. In one embodiment, the core 48 has a volume of about 5% to about 20% of the volume of the internal cavity 46 when the core 48 is in the relaxed state and has a volume of about 20 times to about 40 times the volume of the internal cavity 46 when the core 48 is in the expanded state.

In one embodiment, the core 48 includes an intumescent material configured to expand when exposed to an elevated temperature. In one embodiment, the core 48 is configured to initiate expansion when the core reaches a temperature of 360° F. For example, in one embodiment, core 48 is configured to retain the volume it occupies during its relaxed state until at least a portion of core 48 reaches a temperate of 360° F. In one embodiment, once a portion of core 48 reaches a temperature of 360° F., core 48 is configured to begin expanding. In one embodiment, for so long as the core retains a temperature of 360° F. or exceeds that temperature, core 48 is configured to expand until core 48 expands to its maximum available expansion which may be a function of the originating volume of core 48 or physical restraints driven by the configuration of the closure geometry.

One example of an intumescent material contemplated for use with the present invention is model number CP 648-E manufactured by Hilti North America. In some embodiments, an intumescent material irreversibly expands when exposed to a selected elevated temperature. In some embodiments, the intumescent material increases in volume and decreases in density when exposed to a selected elevated temperature. In some embodiments, the intumescent material produces a light char when exposed to an elevated temperature. In some embodiments, light char includes microporous carbonaceous foam. In some embodiments, microporous carbonaceous foam is formed by a chemical reaction of ammonium polyphosphate, pentaerythritol, and melamine. In some embodiments, the intumescent material produces a hard char when exposed to an elevated temperature. In some embodiments, hard char is formed from at least one of sodium silicates and graphite. In some embodiments, the intumescent material is a low pressure intumescent resin. In some embodiments, the intumescent material undergoes a chemical change when exposed to heat or flames. In some embodiments, the intumescent material is a solid or semi-solid material at room temperature. In some embodiments, the intumescent material becomes viscous when exposed to elevated temperatures and hardens into a solid. In some embodiments, the intumescent material is graphite (e.g., expanding graphite, intercalated graphite).

In one embodiment, the door 42 includes a second core 64 which is configured to resist migration of heat through the door. For example, second core 64 may be configured to resist migration of heat through the door when the door is in the extended position and one side of the door is exposed to an elevated temperature. In one embodiment, second core 64 includes insulation disposed within the internal cavity 46 of the section 44. In one embodiment, the second portion 52 of the internal cavity 46 is configured to receive second core 64. In one embodiment, the second core 64 comprises a steady-state core. In one embodiment, a steady state core is configured to substantially retain its volume when exposed to elevated temperatures. In one embodiment, a steady state core retains its volume when exposed to elevated temperatures up to a threshold that may be selected based on the application to which it is applied. In one embodiment, the second core 64 comprises a steady-state core that does not expand when exposed to such elevated temperatures (e.g., it substantially retains the volume it occupied prior to exposure to high elevated temperature. In one embodiment, the second core 64 comprises a steady-state core that does not expand when exposed to an elevated temperature which would cause the expandable core 48 to begin to expand. In one embodiment, the second core 64 is steady state when exposed to a temperature up to about 165° F. to about 260° F. In one embodiment, the steady-state core is non-combustible until the steady-state core reaches a temperature of about 260° F. In one embodiment, the second core 64 includes rock wool insulation. In one embodiment, the door 42 includes a plurality of sections 44 and some sections include the steady state core only. In one embodiment, the door 42 includes a plurality of sections 44 and some of the sections include both the first core 48 and the second core 64, and some of the sections include only one of the first core 48 and the second core 64. In one embodiment, the door 42 includes a plurality of sections 44 and some of the sections include the first core 48 and the second core 64, some of the sections include the first core only, and some of the sections include the second core only.

In one embodiment, a guide 58 (FIGS. 11-12) is configured to create a seal between sidewall of the opening and the door. For example, the guide may include channel comprising a solid flange such that when the door is in the channel and the core is in the expanded state, the solid flange configuration creates a seal between the door, the channel, and the sidewall that is relatively impervious to heat, air, smoke, and/or fire. In one embodiment, the guide 58 is configured to be coupled (e.g., by a bolt, nail, screw, anchor, adhesive, welding) to a sidewall of the opening. In one embodiment, the guide 58 is configured to receive the door 42 as door 42 moves between the retracted state and the extended state. For example, the guide 58 may include a channel 62 and the door 42 may be positioned within the channel 62. In one embodiment, the core 48 is configured to form a seal with the guide 58 when the core 48 is in the expanded state (e.g., the core may expand from the internal cavity into contact with the guide). In one embodiment, the seal between the guide 58 and the core 48 is configured to be a barrier to heat, air, smoke, and/or fire (e.g., a barrier to the infiltration of heat, air, smoke, and/or fire at undesirable levels which may be a barrier to substantially all migration of heat, air, smoke, and/or fire) when the core 48 is in the expanded state (e.g., as seen in FIGS. 14-16). In one embodiment, at least a part of the segment of the door 42 including the first portion 50 of the internal cavity 46 is received by the guide 58 when the door 42 is in the extended position. In one embodiment, the first portion 50 of the internal cavity 46 is adjacent the guide 58 when the door is in the extended position. In one embodiment, the second portion 52 of the internal cavity 46 is spaced from the guide 58 when the door 42 is within the guide 58.

In one embodiment, the guide 58 comprises a plurality of members having geometric features which may be selected as desired to accommodate a door 42 having a selected thickness. For example, the channel 62 may be the space between the members and the channel may have a width slightly greater than the thickness of the door 42 such that the door can move between the retracted position and the extended position but is prevented from moving beyond a selected plane by the guide 58. In one embodiment, the guide 58 includes a first member 82, a second member 84, and a third member 86. In one embodiment, each of the first member 82, second member 84, and third member 86 includes an L shaped bracket. In one embodiment, each of the first member 82, second member 84, and third member 86 includes an angle iron. In one embodiment, each of the first member 82, second member 84, and third member 86 are configured to be coupled to each other. For example, a connector 88 (e.g., a nut and bolt, weld, adhesive, rivet) may couple one or more of the first member 82, second member, 84, and third member 86 to each other. In one embodiment, a single connector 88 couples each of the first member 82, second member 84, and third member 86 to each other. In one embodiment (not shown), a first connector couples the first member 82 to the second member 84 and a second connector couples the second member 84 to the third member 86.

In one embodiment, the first and second member 82, 84 include a wall and a back that extends away from the wall such that the backs can be coupled together to fix the first member to the second member and the walls form the border of the channel. In one embodiment, the third member 86 includes a back that is configured to be coupled to the backs of the first and second members 82, 84 and a wall configured to be coupled to a sidewall of an opening. In one embodiment, the first member 82 includes the first wall 66 and a first back 90. In one embodiment, the first back 90 is generally perpendicular to the first wall 66. In one embodiment, the second member 84 includes the second wall 68 and a second back 92. In one embodiment, a third wall 96 is coupled to the third back 94 of the third member 86. In one embodiment, the third wall 96 is configured to be coupled to a sidewall of the opening to secure the guide 58 to the opening (e.g., via adhesive, connector, welding).

In one embodiment, each of the first back 90, second back 92, and third back 94 include an aperture configured to receive a connector to secure the members to each other. For example, in one embodiment, the aperture 98 receives the connector 88 to fix the first member 82, second member 84, and third member 86 to each other. In one embodiment, the aperture 98 includes a circular opening. In one embodiment, the aperture 98 includes an elongated opening such that one or more of the members 82, 84, 86 are moveable relative to each other when the connector 88 is within the aperture 98. In one embodiment, the members 82, 84, 86 are moveable relative to each other when the connector 88 is within the aperture 98 but are fixed relative to each other when the connector 88 is in a locked configuration (e.g., when a nut and are in a tightened configuration). In one embodiment, the width of the channel 62 is configured to be selectable. For example, the first member 82 and second member 84 may be moveable relative to each other to change the distance between the first wall 66 and the second wall 68. In one embodiment, the distance of the channel 62 from an edge of a sidewall of the opening is configured to be selectable. For example, the distance between the third wall 96 and the aperture 98 in the third back 94 may be selected as desired to adjust the distance between the channel 62 and a sidewall of an opening.

Figure 2:
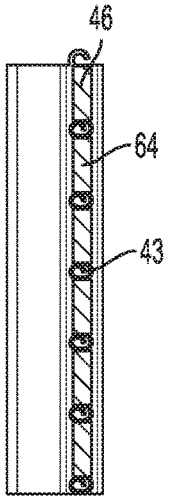
FIG. 2 is a side sectional view of the closure of FIG. 1 along line A-A.

In one embodiment, the guide channel 62 includes an open end on at least one side such that the channel confines the core 48 as the core expands from the relaxed state to the expanded state while the door is within the channel. In one embodiment, the channel 62 includes a width defined by the space between first wall 66 and the second wall 68. In one embodiment, the channel 62 includes a volume defined by the first wall 66, the second wall 68, the first back 90, a plane 87 substantially parallel to the first back 90 (FIG. 12), a lower surface (not shown but could be a floor, for example) and a top of the guide (e.g., where the guide confronts a header). In one embodiment, a ratio of the combined volume of the cores 48 in the door in the relaxed state to the volume of the channel 62 is about 60% to about 80%. In one embodiment, the core 48 occupies about 60% to about 80% of the volume of the channel 62 when the core 48 is in the relaxed state (FIGS. 1-3). In one embodiment, the core 48 occupies about 80% to about 100% of the volume of the channel 62 when the core 48 is in the expanded state (FIGS. 14-16). In one embodiment, the core 48 expands beyond the channel 62 when the core 48 is in the expanded state. For example, the core 48 may expand from the internal cavity 46 of the section 44 into the channel 62 and then out of the open end of the channel after the channel is filled or nearly filled and onto a surface of the door 42 as the core 48 expands from the relaxed state to the expanded state. In one embodiment, a guide layer 80 includes the expanded core 48 within the channel 62 and adjacent to the guide 58 when the core 48 is in the expanded state. In one embodiment, the door 42 is configured to be fixed relative to the guide 58 when the core 48 is in the expanded state. For example, frictional contact between door 42, core 48, and guide 58 may restrict movement of the door when the core is in the expanded state.

In one embodiment, the guide 58 includes a seal 70 (FIGS. 11-12) configured to seal a space between the door 42 and the guide 58 when the door is in the extended position at least until the core 48 begins to expand. For example, the seal 70 may be within the channel 62 and withstand exposure to a temperature (e.g., about 360° F.) at which the core 48 begins to expand. In one embodiment, the seal 70 is configured to be a protective barrier to heat, air, smoke, and/or fire throughout an expansion of the core 48 from the relaxed state to the expanded state. For example, even before the expansion of the core 48, the seal 70 occupies at least a portion of the space between the guide 58 and the door 42 thereby preventing unwanted heat, air, smoke, and/or fire from migrating through the space between the guide and the door. In one embodiment, the seal 70 is a siliconized rubber seal which restricts infiltration of heat, smoke, and/or fire migration when at least one side of the door is exposed to a temperature of about 450° F. In one embodiment, the seal 70 is a siliconized rubber perimeter seal that restricts infiltration of heat, smoke, and/or fire migration at least until the core 48 is in the expanded state under conditions that causes the core 48 to expand. In one embodiment, the seal 70 includes a brush seal, a rubberized seal, etc.

In one embodiment, the guide 58 includes intumescent material configured to provide a seal with the door when at least a portion of the intumescent material reaches a temperature sufficient to cause the intumescent material to expand. For example, the guide 58 may include a layer of intumescent material on at least part of one or more of the exposed surfaces of the channel 62 which begins to expand when a portion of the layer of intumescent material reaches a temperature of about 360° F.

In one embodiment, the closure 40 includes an end cap 122 configured to maintain the position of the door 42 within the guide 58 as the door moves between the retracted and extended positions. For example, the end cap 122 may be coupled to an end of the section 44 such that the end cap 122 is within the guide 58 at least when the door 42 is in the extended position. In one embodiment, the end cap 122 is coupled to the section 44 by a coupling means (e.g., adhesive, bolt, screw, expanding anchor, weld). In one embodiment, the coupling means includes a protrusion that extends into the area defined by the boot 81 (boot shown in FIG. 7). In one embodiment, an end cap 122 is coupled to each section 44. In another embodiment, the end cap 122 is not coupled to every section 44. In other embodiments, an end cap 122 is coupled to every other or every third section. In one embodiment, the end cap 122 is coupled to the section 44 and the section includes the expandable core 48. In one embodiment, the end cap 122 includes an opening (not shown) configured to allow the expandable core 48 to expand from within the section 44 into the guide 58. In one embodiment, the end cap 122 covers about 50% to about 100% of the area of the opening at the end of the section. In one embodiment, the end cap 122 includes an uninterrupted surface that prevents the core 48 from flowing through the end cap 122, but the end cap 122 covers less than 100% of the opening at the end of the section 44 such that the core 48 can expand from the section 44 when exposed to a selected minimum temperature. In one embodiment, the end cap 122 remains fixed to the section 44 as the core 48 expands. In another embodiment, the end cap 122 detaches from the section 44 as the core 48 expands.

In one embodiment, the closure 40 includes a seal (e.g., on a bottom of the door 42) that is configured to provide a seal between the bottom of the door and a bottom of the opening when the door is in the extended position. In one embodiment, the seal 72 is configured to withstand exposure to a temperature of at least about 400° F. For example, the seal may include siliconized rubber seal that does not melt when one side of the door is exposed to a temperature of about 400° F. In one embodiment, the seal 72 remains intact (e.g., does not melt) to a temperature of at least about 500° F. In one embodiment, the seal 72 remains intact to a temperature of at least about 600° F. In one embodiment, the seal 72 remains intact to a temperature of at least about 350° F. above ambient temperature. In one embodiment, the seal 72 remains intact to a temperature of at least about 400° F. above ambient temperature. In one embodiment, the seal 72 remains intact to a temperature of at least about 450° F. above ambient temperature. In one embodiment, the seal 72 remains intact until the core 48 forms a seal with the bottom of the opening. In one embodiment, the seal 72 includes a siliconized rubber astragal. In one embodiment, the seal 72 includes a siliconized rubber loop or blade. In one embodiment, the core 48 is configured to expand before the seal degrades such that the door 42 includes a first barrier to heat, smoke, air, and fire (e.g., the expanded core 48) and a second barrier to heat, smoke, air, and fire (e.g., the seal).

Figure 9:
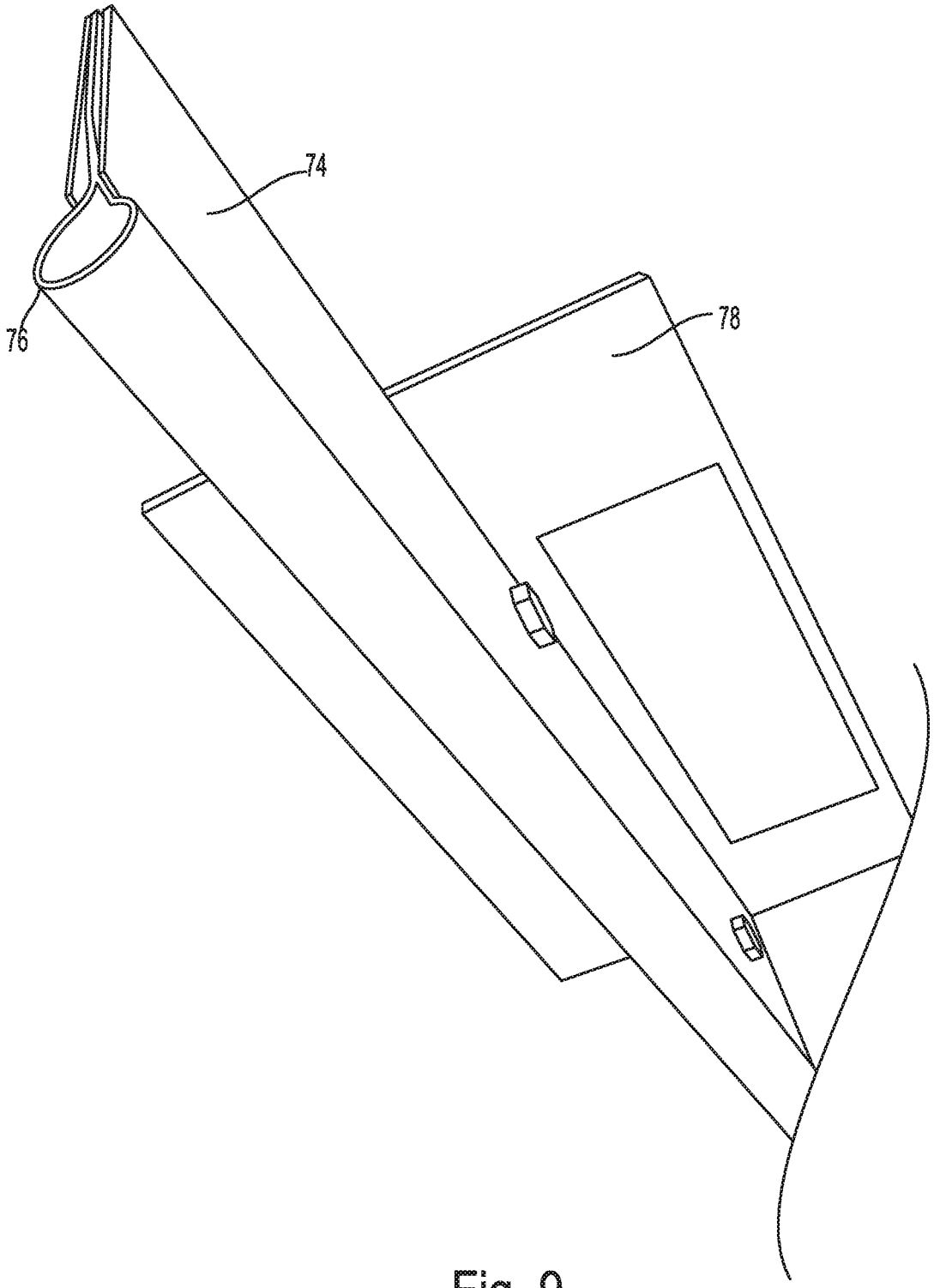
FIG. 9 is a top perspective view of a bottom bar in accordance with one embodiment of the present invention.
Figure 10:
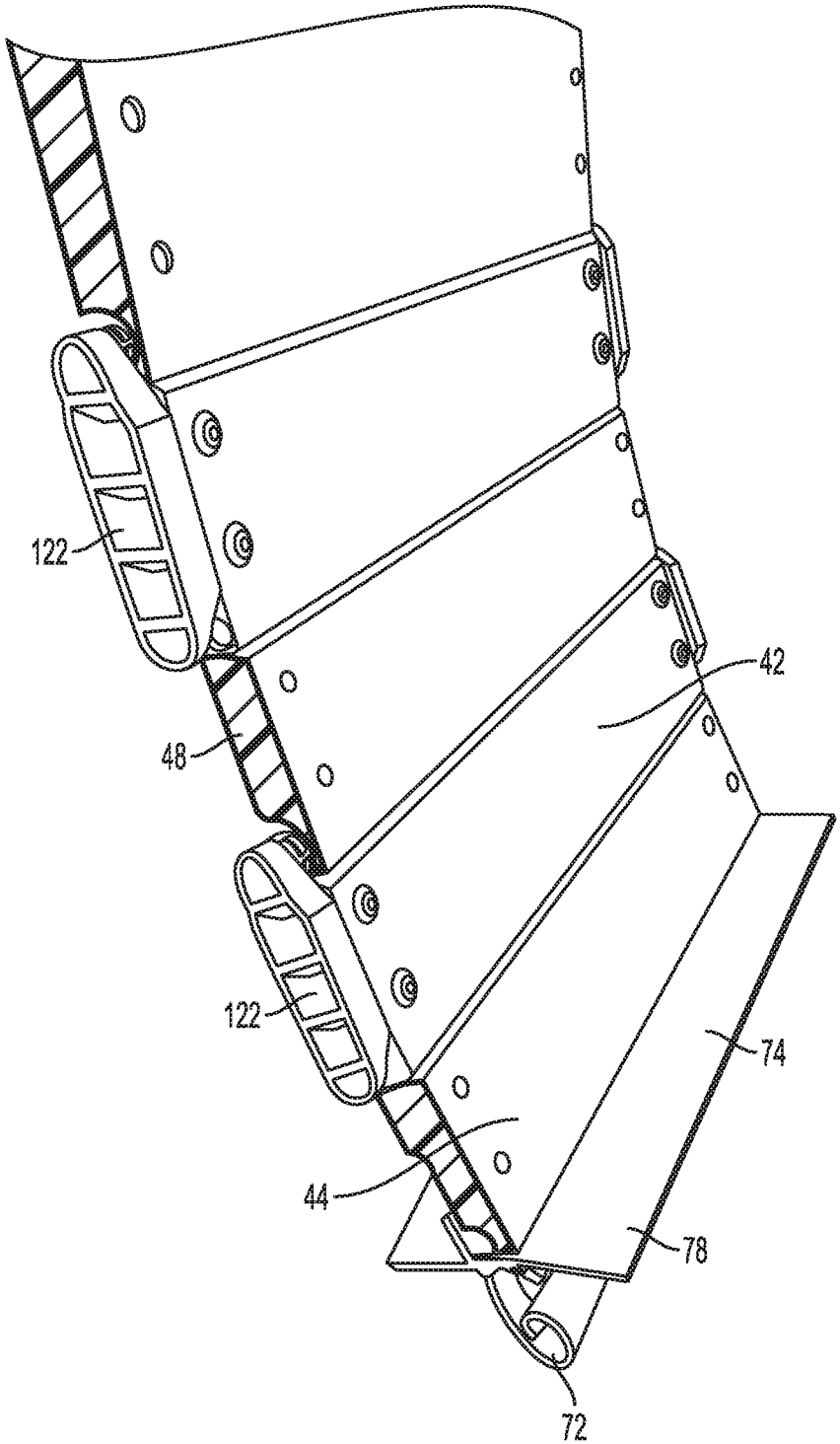
FIG. 10 is an isolated side perspective view of the door of FIG. 1.
Figure 11:
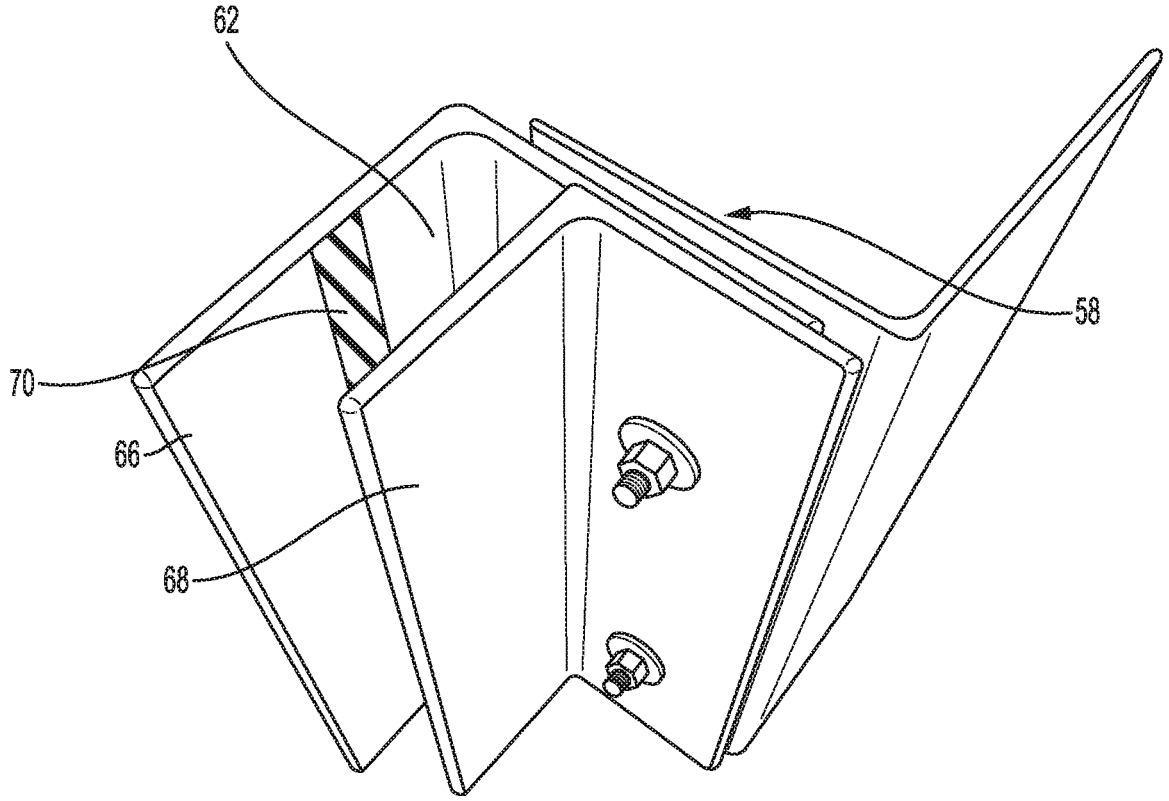
FIG. 11 is a top perspective view of the guide of FIG. 1.
Figure 12:
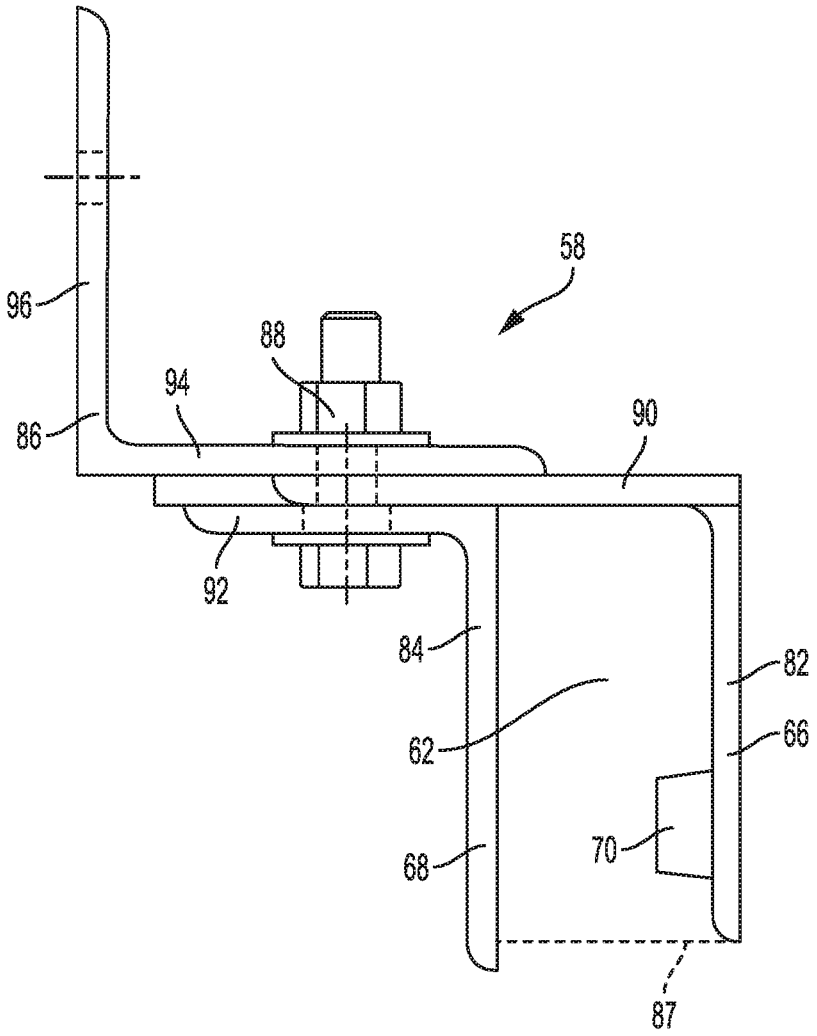
FIG. 12 is a top view of the guide of FIG. 1.
Figure 13:
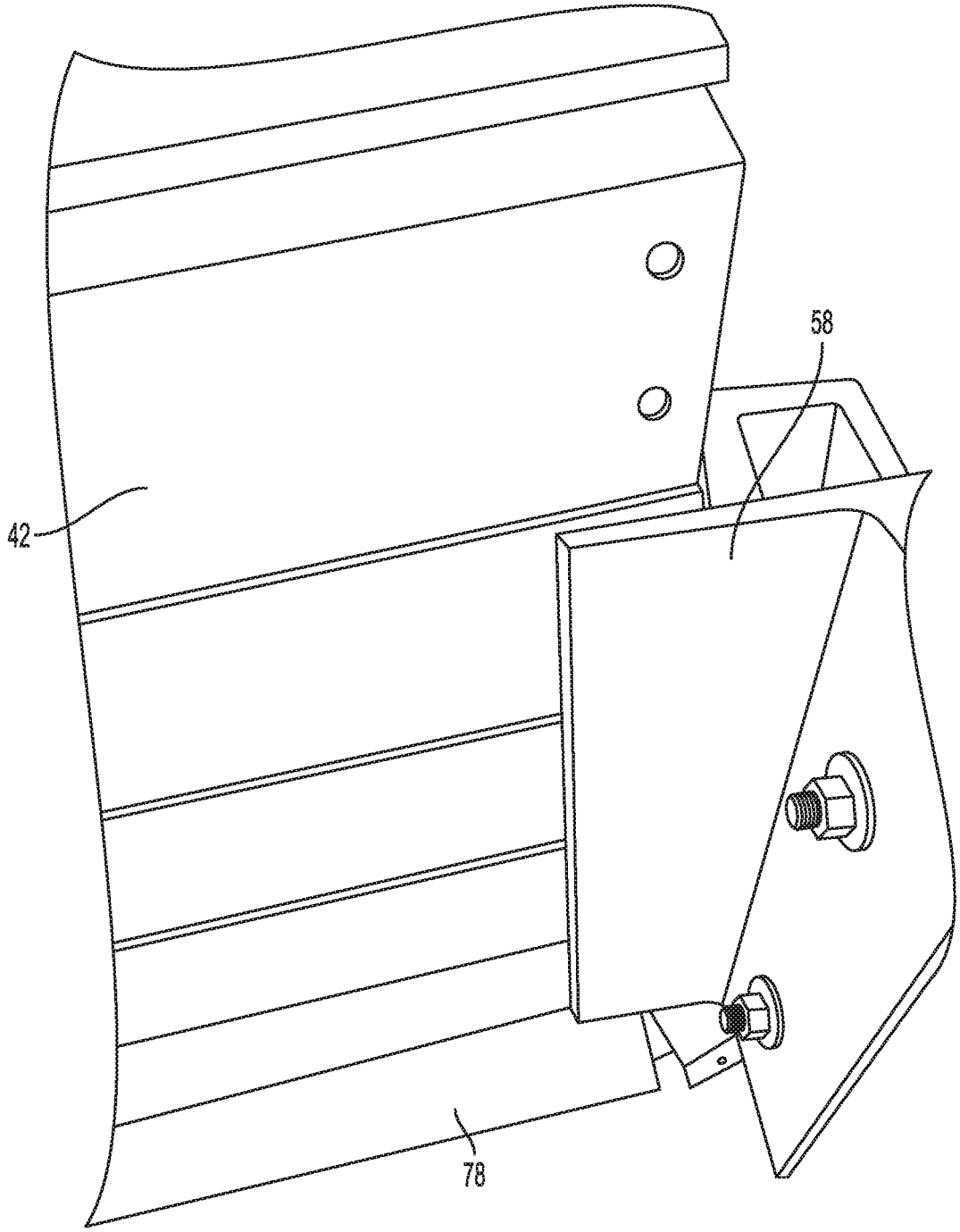
FIG. 13 is a close up top perspective view of the closure of FIG. 1.

In the embodiment of FIGS. 9 and 10, a bottom bar is configured to permit the multicomponent segmented door to terminate in a readily sealable configuration. For example, in one embodiment, the seal 72 is coupled to a bottom bar 74 which is coupled to the bottom of the door 42. In one embodiment, a coupling is configured to attach the bottom bar 74 to the bottom section 44 of the door 42. For example, in one embodiment, the coupling is a fastener (e.g., weld, threaded connector, or rivet). In other embodiments, the bottom bar 74 may be designed and dimensioned to couple to the boot 81 of the bottom section 44 of the door 42. In one embodiment, the bottom bar 74 includes a bottom plate 78. In one embodiment, the bottom plate 78 includes an enlarged surface area compared to the bottom section 44 of the door 42. In one embodiment, the seal 72 is coupled to the bottom plate 78 (e.g., by adhesive, screw, threaded fastener).

In one embodiment, the seal 72 is configured to be compressed between the bottom of the opening and the bottom plate 78 when the door 42 is in the extended position. For example, in one embodiment, at least one geometric feature (e.g., height, width, length) of the seal 72 changes as the door 42 moves from the retracted position to the extended position and the space between a lower surface of the bottom plate 78 and the bottom of the opening is smaller than the uncompressed dimension of the at least one geometric feature of the seal 72.

Figure 17:
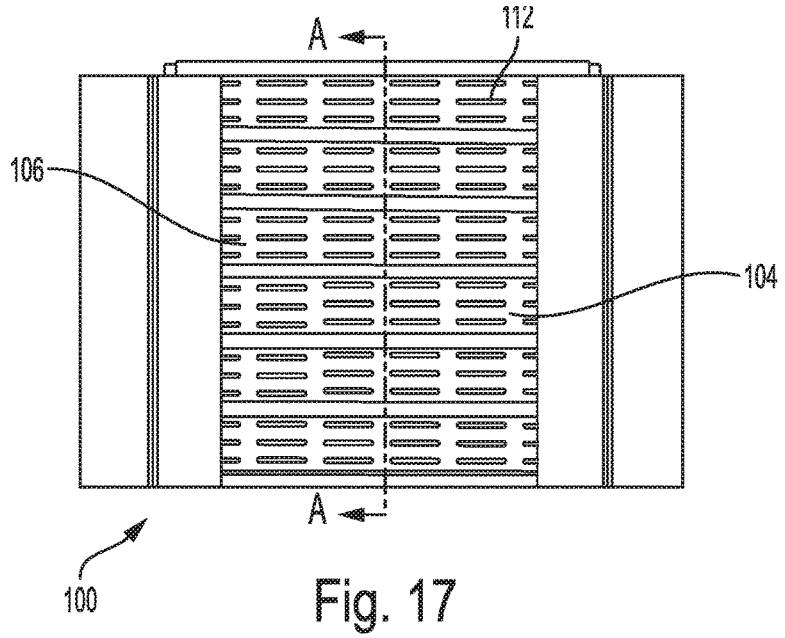
FIG. 17 is a front view of a closure in accordance with an exemplary embodiment of the present invention.
Figure 18:
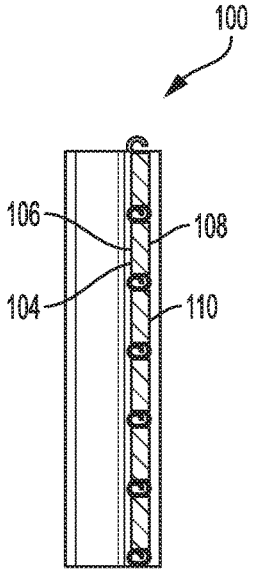
FIG. 18 is a side sectional view of the closure of FIG. 17.
Figure 19:
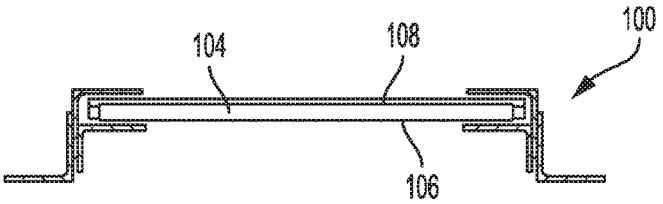
FIG. 19 is a top view of the closure of FIG. 17.
Figure 35:
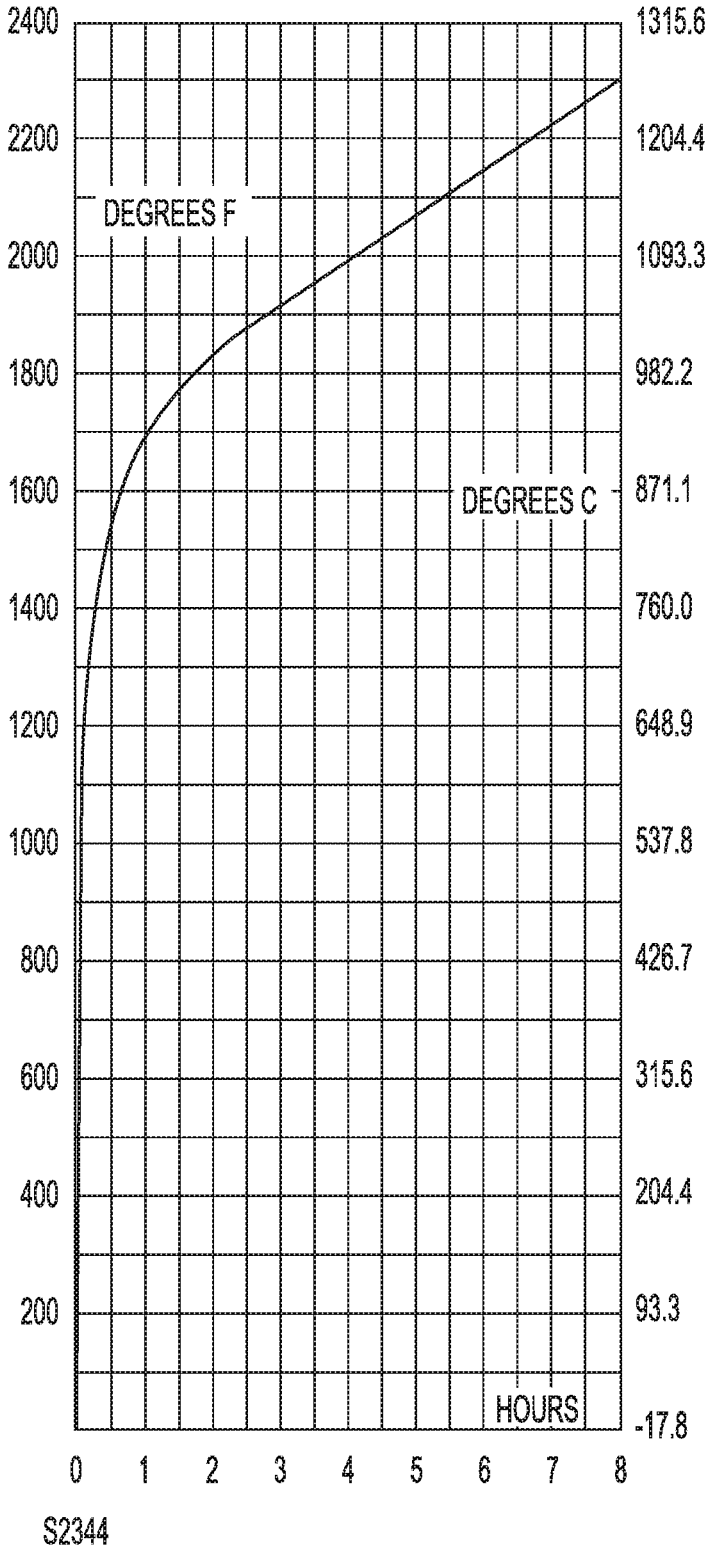
FIG. 35 is a time temperature curve.

In one embodiment, a door is configured to include slats having a plurality of perforations configured to introduce an expandable material from within the door to an external surface of the door such that the door includes a layer of material on a first surface of the door when the expandable material is in the expanded state. Turning now to FIGS. 17-19, one embodiment of a closure, generally designated 100, is shown. In one embodiment, the closure 100 includes intumescent material disposed in openings throughout door 102 in a configuration that creates a barrier to the undesirable migration of heat, air, smoke, and/or fire through door 102, in spite of numerous gaps in the door under normal temperature conditions. In one embodiment, the closure 100 includes intumescent material within every slat (e.g., within a hollow core of every slat) such that when a fire event creates a certain elevated temperature, the intumescent material expands, filling the gaps (e.g., the gaps between the curtain and the vertical guides), creating a protective barrier to heat, air, smoke, and/or fire that maintains a seal at temperatures of at least 350° F. In one embodiment, the closure creates a seal at temperatures higher than the 400° F. required by UL 1784. In one embodiment, the door 102 is configured to provide a barrier to heat, air, smoke, and/or fire to a temperature of about 450° F. above an ambient temperature. In one embodiment, the door 102 is a barrier to heat, air, smoke, and/or fire when one side of the door 102 is exposed to temperatures up to about 450° F. above an ambient temperature at a 30-minute mark in compliance with a standard underwriter's laboratories time-temperature curve (time-temp curve best seen in FIG. 35).

In one embodiment, the closure 100 includes intumescent material within a section of a door and the section is perforated at planned locations (e.g., facing an opening header) such that when a fire event creates a certain elevated temperature, the intumescent material expands, filling the gaps between the curtain and the header, thus completing a high temperature seal on three sides of the opening. In one embodiment, intumescent material is within each section (e.g., within a core of each section) such that when a fire event creates a certain elevated temperature, the intumescent material expands outward through the perforations in the sections into a protective barrier on the face of the sections.

In one embodiment, the closure 100 includes a door 102 with one or more sections 104. In one embodiment, each section 104 includes a first surface 106 and a second surface 108. In one embodiment, the door 102 includes an internal cavity 110 between the first surface 106 and the second surface 108. In one embodiment, the second surface 108 is similar to second surface 49. For example, second surface 108 may include the second cap 69, second wall 68, and second boot 75 as described in connection with second surface 49. In one embodiment, second surface 108 is configured to prevent migration of the expandable core through the second surface. For example, second surface 108 may be a solid surface.

In one embodiment, the first surface of the door 102 includes perforations such that the core migrates through the perforations creating a sealing layer on the door as the core expands. In one embodiment, a perforation 112 extends through the first surface 106 and is configured to be a conduit to the internal cavity 110. For example, the perforation 112 may be a tunnel in fluid communication with the internal cavity 110 and an external side of the first surface 106. In one embodiment, the perforation 112 is configured to promote the formation of a seal on the first surface 106 of the door 102. For example, the size, position, orientation, quantity, etc. of the perforations 112 may be selected such that the core forms a protective barrier when the core is in the expanded state. In one embodiment, the perforations 112 have a surface area of about 40% to about 60% of the total surface area of the first surface 106. In one embodiment, the first surface 106 includes a single perforation. In one embodiment, the first surface 105 includes a plurality of perforations 112 and at least one of the plurality of perforations has a different geometric property (e.g., length, width) than another of the perforations. In one embodiment, the first surface 106 is similar in some respects to the first surface 47. For example, the first surface 106 may include the first cap 53, first wall 51, and first boot 55 as described regarding first surface 47, but first surface 106 includes perforations 112. In one embodiment, the door 102 includes a plurality of sections 104 and each section has the same number of perforations 112. In one embodiment, the door 102 includes a plurality of sections 104 and at least one of the sections has a different number of perforations 112 than another of the plurality of sections. In one embodiment, the door 102 includes a plurality of sections 104 and each section includes the same perforation layout pattern. In one embodiment, the door 102 includes a plurality of sections 104 and at least one of the sections has a different perforation layout pattern than another of the plurality of sections.

In one embodiment, the internal cavity 110 is configured to receive the core 48. In one embodiment, the internal cavity 110 extends the length of each section 104. In one embodiment, the internal cavity 110 comprises one or more portions of the length of each section. In one embodiment, the door 102 includes a plurality of sections 104, each having one or more internal cavities 110. In one embodiment, some of the plurality of sections 104 include an internal cavity 110 and the other of the plurality of sections 104 do not include an internal cavity. In one embodiment, at least one of the plurality of sections 104 include an internal cavity 110 having a volume different than the volume of the internal cavity of another of the plurality of sections. In one embodiment, the section 104 comprises a plurality of independent internal cavities. In one embodiment, a ratio of the volume of the internal cavity 110 to the total volume of the section 104 is configured to be about 20% to about 40%. In one embodiment, the combined volume of the internal cavities 110 of all of the sections 104 is configured to be about 20% to about 40% of the total volume of the door 102.

Figure 20:
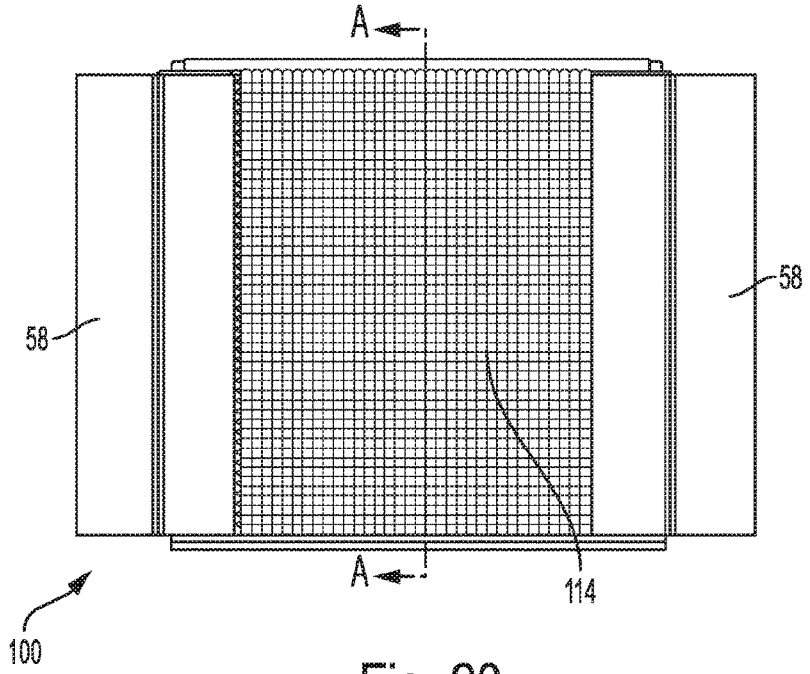
FIG. 20 is a front view of the closure of FIG. 17 with the core in an expanded state.
Figure 21:
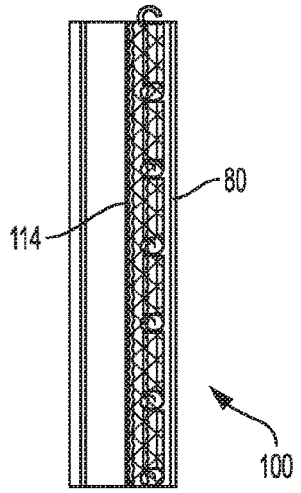
FIG. 21 is a side sectional view of the closure of FIG. 17 with the core in an expanded state.
Figure 22:
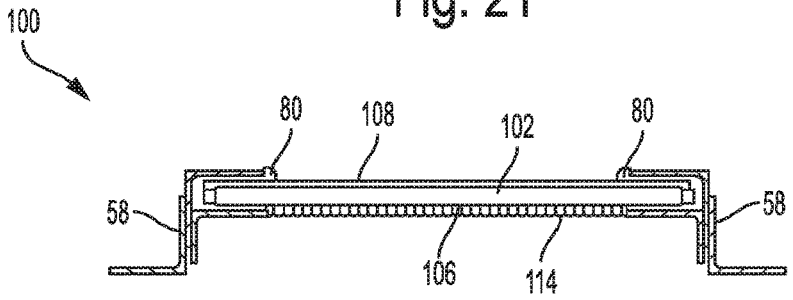
FIG. 22 is a top view of the closure of FIG. 17 with the core in an expanded state.
Figure 23:
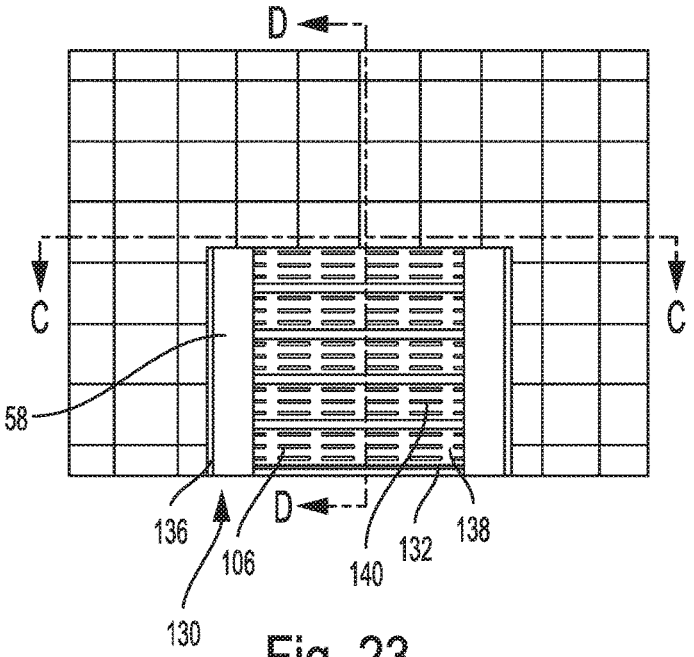
FIG. 23 is a front view of a closure in accordance with an exemplary embodiment of the present invention.
Figure 24:
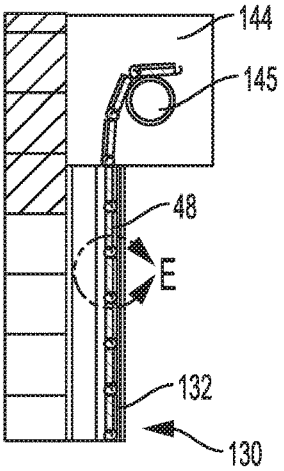
FIG. 24 is a side sectional view of the closure of FIG. 23.
Figure 25:
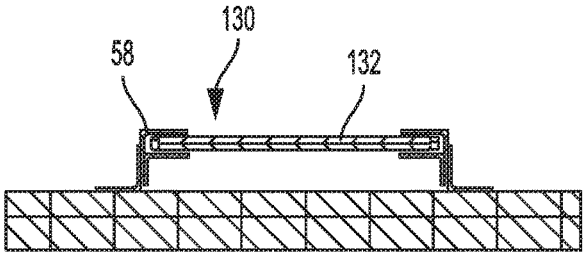
FIG. 25 is a top view of the closure of FIG. 23

In one embodiment, the door 102 includes the core 48 and the core is configured to seal a space between the door and the guide as well as forming a protective layer on one side of the door when the core is in the expanded state. In one embodiment, the core 48 is within the internal cavity 110 of the door 102 when the core 48 is in the relaxed state. In one embodiment, the core 48 is configured to expand when at least a portion of the core reaches a temperature of about 360° F. In one embodiment, the core 48 is configured to expand out of the internal cavity 110, through the perforation 112 and onto an external side of the first surface 106 (FIGS. 20-22). In one embodiment, a core layer 114 is configured to cover about 80% to about 100% of the external side of the first surface 106 when the core 48 is in the expanded state. For example, the core 48 may expand from the internal cavity 110 through the perforation and onto the external side of the first surface 106, forming the core layer 114. In one embodiment, the core 48 is configured to form the core layer 114 when the door is exposed to a temperature of about 260° F. to about 360° F. In one embodiment, the core 48 is configured to expand from an end of the door 102 to form a seal with the guide 58 (e.g., the guide layer 80) as previously described. In one embodiment, the guide layer 80 and the core layer 114 are configured to be a continuous element when the core 48 is in the expanded state. For example, the core 48 may expand out of the internal cavity 110 onto the first surface 106 and into contact with the core 48 that has expanded out of the guide 58 forming a single combined layer at least partially surrounding the door on three sides.

In one embodiment, a door is configured to include sections having a plurality of perforations on opposing surfaces of the section to introduce expandable material from within the door to external surfaces of the door such that the door includes a layer of material on a first surface and a second surface of the door when the material is in the expanded state. Turning now to FIGS. 23-34, one embodiment of a closure, generally designated 130, is shown. In one embodiment, the closure 100 introduces intumescent material into the hollow core of every slat such that when a fire event creates a certain elevated temperature, the intumescent material expands, filling the gaps between the curtain and the vertical guides, creating a barrier to heat, air, smoke, and/or fire that maintains a seal at temperatures higher than the 400° F. required by UL 1784. In one embodiment, the closure 100 includes a section comprising intumescent material and perforations at planned locations facing an opening header such that when a fire event creates a certain elevated temperature, the intumescent material expands, filling the gaps between the curtain and the header thereby creating a seal on four sides of the opening. In one embodiment, each section contains intumescent material (e.g., within a hollow core of the section) such that when a fire event creates a certain elevated temperature, the intumescent material expands outward through perforations in the first and second surfaces of the sections to form a protective barrier on the two sides of the sections. In one embodiment, the closure 130 creates a barrier to heat, air, smoke, and/or fire to temperatures of about 2000° F. In one embodiment, the closure comprises a door and withstands temperatures up to about 2000° F. In one embodiment, the door undergoes a maximum temperature rise of 250° F. over an ambient temperature on one of the first surface and the second surface when the other of the first surface and the second surface are exposed to an increased temperature. In one embodiment, the door undergoes a maximum temperature rise of 250° F. over an ambient temperature on one of the first surface and the second surface when the other of the first surface and the second surface are exposed to an increased temperature for a selected time period. In one embodiment, the door comprises a plurality of additional sections, each of the sections having front perforations and back perforations that are configured to permit the core to migrate through the front perforations and the back perforations when the core transitions to the expanded state.

In one embodiment, the closure 130 comprises a door 132 moveable along the guide 58 from a retracted position to an extended position. In one embodiment, the door 132 comprises one or more sections 138. In one embodiment, the section 138 comprises the first surface 106 and a second surface 134. In one embodiment, the internal cavity 110 is between the first surface 106 and the second surface 134. In one embodiment, the door 132 seals an opening 136 when the door is in the extended position and the core 48 is in the expanded state.

Figure 26:
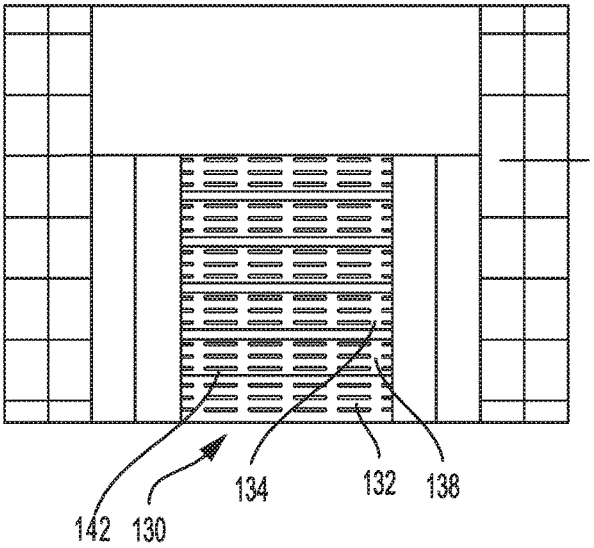
FIG. 26 is a rear view of the closure of FIG. 23.

In one embodiment, a first perforation 140 extends through the first surface 106 (FIG. 23) as previously described. In one embodiment, the first perforation 140 is a conduit to the internal cavity 110. In one embodiment, a second perforation 142 is configured to be a conduit between the internal cavity 110 and an area external to the second surface 134 (FIG. 26). In one embodiment, the second surface 134 is similar in some respects to second surface 49. For example, second surface 134 may include the second cap 69, second wall 68, and second boot 75 but second surface 134 includes the second perforation 142. In one embodiment, the second perforation 142 is configured to be a conduit to the internal cavity 110. For example, the core 48 may expand from the internal cavity 110 through the second perforation 142 and onto the second surface 134. In one embodiment, the first perforation 140 and second perforation 142 have at least one similar geometric feature (e.g., length, width, perimeter, shape, layout pattern).

In one embodiment, the perforations 140, 142 are configured to promote the formation of a seal on the first surface 106 and second surface 134 of the door 132. For example, the size, position, orientation, quantity, etc. of the perforations 140, 142 may be selected such that the core forms a protective barrier when the core is in the expanded state. In one embodiment, the first surface 106 comprises a plurality of first perforations 140. In one embodiment, the second surface 134 comprises a plurality of second perforations 142. In one embodiment, the quantity of first perforations 140 and second perforations 142 are equal. In one embodiment, the quantity of first perforations 140 is greater than the quantity of second perforations 142. In one embodiment, the quantity of first perforations 140 is less than the quantity of second perforations 142. In one embodiment, the combined surface area of the plurality of first perforations 140 is equal to the combined surface are of the plurality of second perforations 142. In one embodiment, the quantity of first perforations 140 is not equal to the quantity of second perforations 142 but the combined surface area of the first perforations 140 is equal to the combined surface are of the second perforations 142. In one embodiment, the first perforation 140 and second perforation 142 each have an axis of symmetry and the axes are co-axial. In one embodiment, the first perforation 140 and second perforation 142 each have an axis of symmetry and the axes are offset from one another. In one embodiment, the door 132 includes a plurality of sections 138 and each section comprises the first perforations 140 and the second perforations 142. In one embodiment, at least one of the plurality of sections 138 does not include the first perforation 140. In one embodiment, at least one of the plurality of sections 138 does not include the second perforation 142. In one embodiment, at least one of the first perforation 140 and the second perforation 142 are within a boundary defined by the guide 58. In one embodiment, the core 48 expands from the first portion 50 of the internal cavity 46 and out through the perforations 140, 142 as the core transitions from the relaxed state to the expanded state.

Some embodiments of the closure 130 include an opening header to store the door when the door is in the retracted position. In one embodiment, the door 132 is a coiling door moveable from a retracted position to an extended position. In one embodiment, an opening header 144 (FIG. 28) is configured to the door 132 when the door is in the retracted position. For example, in one embodiment, the header 144 includes a rotatable axis 145 that retracts and extends the door 132 as the axis 145 rotates. In one embodiment, the opening header 144 comprises an enclosed container. In one embodiment, the opening header 144 includes a substantially enclosed container with a header space 146 between the door 132 and the opening header 144 when the door is in the extended position. In one embodiment, the door 132 moves through the header space 146 as the door 132 transitions between the retracted position and the extended position. In one embodiment a perimeter seal 70 along the guide 58 and the opening header 144 is configured to provide a seal between the door 132 and each of the guide and the opening header during an expansion of the core 48.

Some embodiments of the door 132 include the core 48 which is configured be a protective barrier in the guide and on a surface of the door when the core 48 is in the expanded state. In one embodiment, the internal cavity 110 is configured to receive the core 48. (FIG. 18). For example, the internal cavity 110 may be a void and the core 48 may be within the void. In one embodiment, the core 48 is configured to expand from a relaxed state (FIGS. 23-28) to an expanded state (FIGS. 29-34) when exposed to an environmental condition (e.g., one or both sides of the door exposed to a sufficiently elevated temperature). In one embodiment, the core 48 is configured to expand from the internal cavity 110 through the first perforation 140 and the second perforation 142 as the core transitions to the expanded state. In one embodiment, the section 138 includes a first layer 162 when the core 48 is in the expanded state. For example, the first layer 162 may be formed by the expanded core 48 and cover some (or all) of the first surface 106 when the core 48 is in the expanded state. In one embodiment, the section 138 includes a second layer 164 when the core 48 is in the expanded state. For example, the second layer 164 may be formed by the expanded core 48 and cover some (or all) of the second surface 134 when the core 48 is in the expanded state. In one embodiment, the core 48 is configured to be received by the internal cavity 110 when the core 48 is in the relaxed state. In one embodiment, the core 48 is configured to be received by the internal cavity 110 and at least partially extends into one of the first perforation 140 and the second perforation 142 when the core 48 is in the relaxed state. In one embodiment, the core 48 is configured to be received by the internal cavity 110 and at least partially extends into the first perforation 140 and the second perforation 142 when the core 48 is in the relaxed state. In one embodiment, the core 48 is configured to be received by the internal cavity 110 and extends into the first perforation 140 and the second perforation 142 when the core 48 is in the relaxed state such that the core 48 is within a plane defined by at least one of the first surface 106 and the second surface 134.

One embodiment of the door 132 includes a divider configured to direct the expansion of intumescent material. In one embodiment, for example, a divider 152 promotes the expansion of the core 48 through the first perforation 140 and the second perforation 142 by allowing expansion of the core in only one direction (e.g., away from the divider). In one embodiment, door 132 includes the divider 152 between the first surface 106 and the second surface 134. In one embodiment, the divider 152 is configured to separate the internal cavity 110 into a first cavity portion 154 and a second cavity portion 156. For example, the divider 152 may be a barrier extending from the top to the bottom of the internal cavity 110 such that the first cavity portion 154 and second cavity portion 156 are separated from each other. In one embodiment, the divider 152 is configured to isolate the first cavity portion 154 from the second cavity portion 156. In one embodiment, the divider 152 is configured to prevent visibility or pass through of heat, air, fire, and/or smoke between the first cavity portion 154 and the second cavity portion 156 (e.g., when subject to a hose test per UL standards). In one embodiment, divider is configured to partially isolate the first cavity portion 154 from the second cavity portion 156. For example, the divider 152 may include an aperture (not shown) or may not completely extend from the top to the bottom of the internal cavity 110 such that the first and second cavity portions are in fluid communication with each other. In one embodiment, the divider 152 is configured to be coupled to at least one of the first surface 106 and the second surface 134 (e.g., by welding, adhesive, connector). In one embodiment, the divider 152 is configured to be a floating divider. For example, the divider 152 may be positioned within the internal cavity 110 but may not be fixed to either of the first surface 106 and the second surface 134 such that the divider may float (e.g., rotate, slide, translate, migrate) within the internal cavity.

In one embodiment, the core 48 includes a first core portion 158 in the first cavity portion 154 and a second core portion 160 in the second cavity portion 156. In one embodiment, the first core portion 158 is configured to confront the first surface 106 of the section 138 and the second core portion 160 is configured to confront the second surface 134 of the section 138. For example, the first core portion 158 may be positioned between the divider 152 and the first surface 16 and the second core portion 160 may be positioned between the divider 152 and the second surface 134. In one embodiment, the divider 152 includes a fire resistant material (e.g., steel, aluminum). In one embodiment, the divider 152 comprises rock wool insulation. In one embodiment, the divider 152 is rigid (e.g., the divider does not bend or flex when as the core expands). In one embodiment, the divider 152 is pliable (e.g., the divider moves, twists, bends, or flexes as the core expands). In one embodiment, the divider 152 is configured to separate the internal cavity 110 into two portions of equal volume. In one embodiment, the first core portion 158 and the second core portion 160 include the same material (e.g., both are the same intumescent material). In one embodiment, the first core portion 158 and the second core portion 160 include different materials. For example, the first core portion 158 may include a first intumescent material configured to expand at a first temperature and the second core portion 160 may include a second intumescent material configured to expand at a second temperature different from the first temperature.

Figure 29:
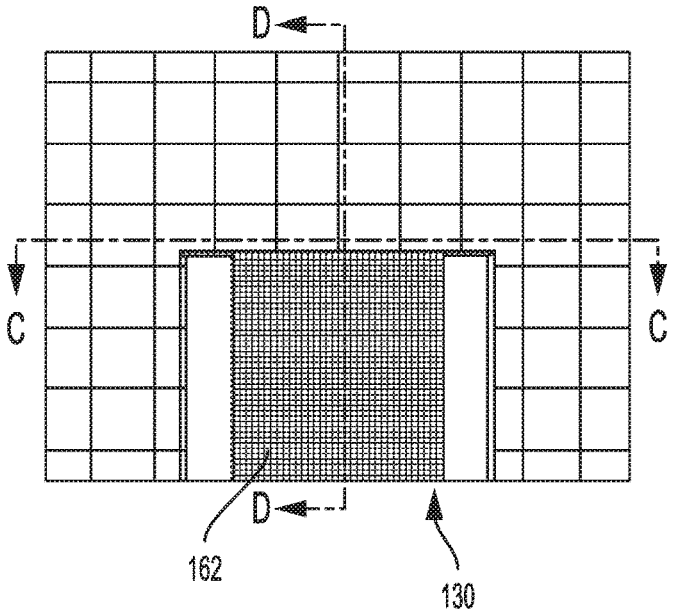
FIG. 29 is a front view of the closure of FIG. 23 with the core in an expanded state.
Figure 30:
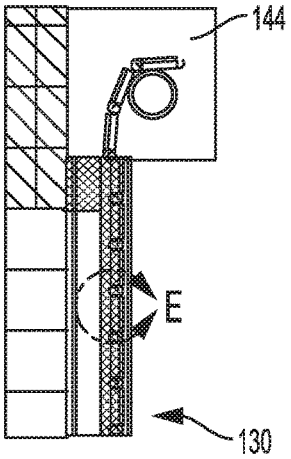
FIG. 30 is a side sectional view of the closure of FIG. 23 with the core in an expanded state.
Figure 31:
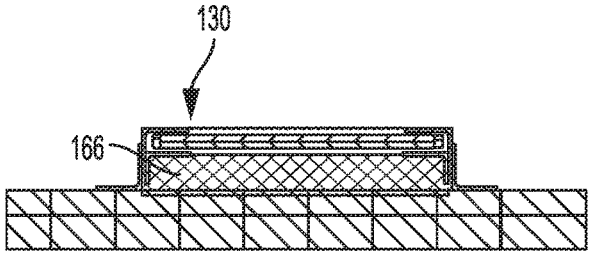
FIG. 31 is a top view of the closure of FIG. 23 with the core in an expanded state.
Figure 32:
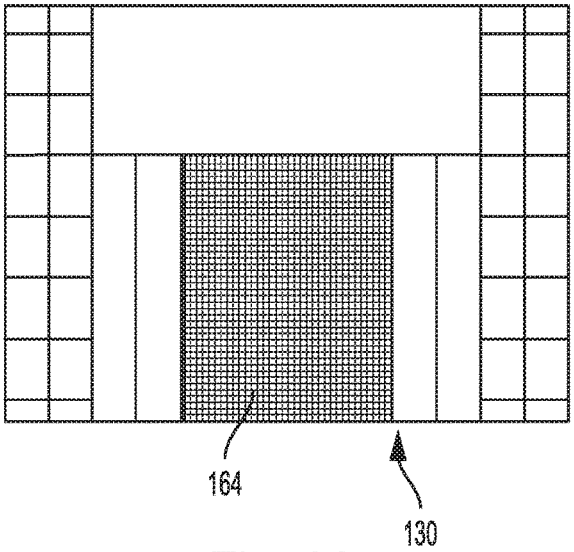
FIG. 32 is a rear view of the closure of FIG. 23 with the core in an expanded state.
Figure 34:
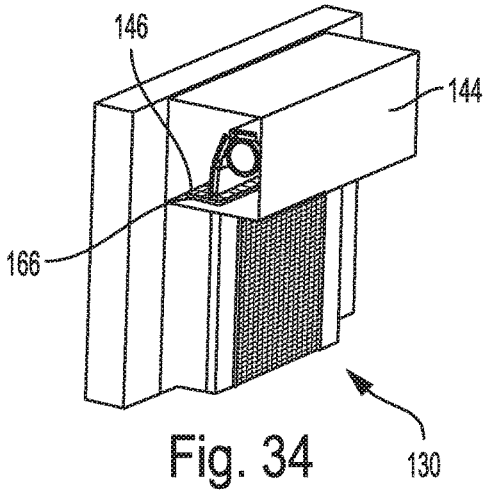
FIG. 34 is a top, side perspective view of the closure of FIG. 23 with the core in an expanded state.

The expanded core shown in FIG. 29 includes an additional layer on the door compared to previously described embodiments. For example, the expanded core may include a layer on opposing sides of the door, within the guide, and within a header space when the core is in the expanded state. In one embodiment, a first layer 162 is configured to be adjacent the first surface 106 when the core 48 is in the expanded state (FIG. 29). For example, the first core portion 158 may expand from the first cavity portion 154 through the first perforation 140 in the first surface 106 and form the first layer 162 adjacent the first surface 106 when the first core portion is exposed to an environment which causes the core portion to expand (e.g., when the core portion reaches a temperature of about 360° F.). In one embodiment, a second layer 164 is configured to be adjacent the second surface 134 when the core 48 is in the expanded state (FIG. 32). For example, the second core portion 160 may expand from the second cavity portion 156 through the second perforation 142 in the second surface 134 and form the second layer 164 when the second core portion is exposed to an environment which causes the core portion to expand (e.g., when the core portion reaches a temperature of about 360° F.). In one embodiment, at least one of the first core portion 158 and the second core portion 160 are configured to seal the header space 146 when the core is in the expanded state (FIG. 34). In one embodiment, at least one of the first core portion 158 and the second core portion 160 are configured to be a header layer 166 within the header space 146 when the core is in the expanded state. For example, one or both of the core portions 158, 160 may expand from the respective cavity portion 154, 156 through the respective perforation 140, 142 and into the header space 146 creating a header layer 166 when the core is exposed to an environment which causes the core portion to expand (e.g., when the core portion reaches a temperature of about 360° F.). In one embodiment, the header layer 166 is a protective barrier that prevents unwanted migration of heat, air, smoke, and/or fire through the header space 146.

In one embodiment, the first layer 162, second layer 164, header layer 166, and guide layer 80 are configured to be a continuous layer at least partially surrounding the door 132 when the core 48 is in the expanded state. For example, the first layer 162 may cover (some or all) of the first surface 106 and blend into the guide layer 80 and header layer 166 such that there is no separation between the guide layer, header layer, and the first layer. Similarly, the second layer 164 may blend into the guide layer 80 and header layer 166 such that the door 132 is surrounded (partially or completely) on four sides by a single continuous layer. In one embodiment, the continuous layer is configured to be a protective barrier to prevent unwanted migration of heat, air, smoke, and/or fire through the opening when the core is in the expanded state.

Figure 33:
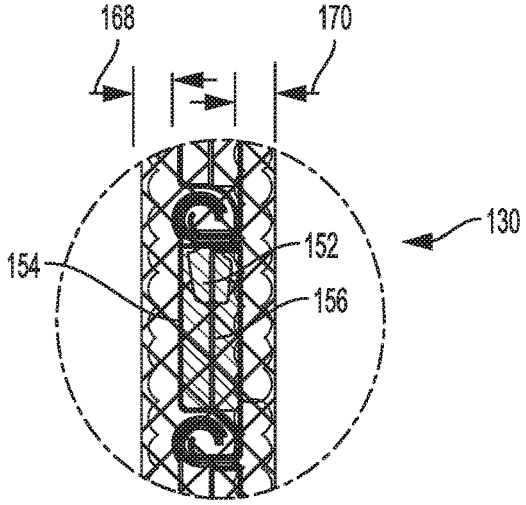
FIG. 33 is a close up detail view of the closure of FIG. 23 with the core in an expanded state.

In one embodiment, the core is configured to expand until the geometry surrounding the door prevents the core from further expansion or the core reaches an expansion limit. In one embodiment, the thickness of the expanded core layer may influence the resistance of the layer to heat, air, smoke, and/or fire. In one embodiment, the first layer 162 is defined by a first layer thickness 168 when the core 48 is in the expanded state (FIG. 33). In one embodiment, the second layer 164 is defined by a second layer thickness 170 when the core 48 is in the expanded state. In one embodiment, the first layer thickness 168 and second layer thickness 170 are equal. In one embodiment, the first layer thickness 168 is greater than the second layer thickness 170. In one embodiment, the first layer thickness 168 is less than the second layer thickness 170. In one embodiment, the first layer 162 has a surface area of about 80% to about 100% of the first surface 106 surface area when the core 48 is in the expanded state. In one embodiment, the second layer 164 has a surface area of about 80% to about 100% of the second surface 134 surface area when the core 48 is in the expanded state.

In one embodiment, the first core portion 158 and the second core portion 160 are configured to expand simultaneously. For example, the core portions 158, 160 may simultaneously begin to expand when one side (or both) of the door is exposed to a minimum temperature for a minimum time period that causes the core to expand. In one embodiment, core portion 158, 160 corresponding to the surface 106, 134 exposed to an elevated temperature is configured to expand before the other of the core portion 158, 160 corresponding to the surface 106, 134 not exposed to an elevated temperature. For example, the core portion confronting the side of the door exposed to the elevated temperature may reach a minimum expansion temperature before the other core reaches the minimum expansion temperature. In one embodiment, the first core portion 158 is configured to expand at a first temperature and the second core portion 160 is configured to expand at a second temperature different from the first temperature. For example, the first core portion 158 may begin to expand at a lower temperature than the second core portion 160 such that the first layer is formed and provides resists the migration of heat through the opening before the second core portion begins to expand. In one embodiment, the first core portion 158 and the second core portion 160 are configured to have a similar rate of expansion (e.g., both are configured to expand by about 2000% to about 4000% of their original volume within a similar time frame). For example, the first core portion 158 may expand to have an expanded volume of 100% greater than a relaxed volume of the first core portion 158 within 10, 20, 30, 60, 120, 300, 400, 500, 600, 700, 800, 900, 1,000, 1,500, 2,000, 2,500, 3,000, or 3,600 seconds. In one embodiment, the volume of the first layer 162 is configured to be about 50% to about 200% of the volume of the second layer 164 when the first core portion 158 and the second core portion 160 are both in the expanded state.

Figure 37:
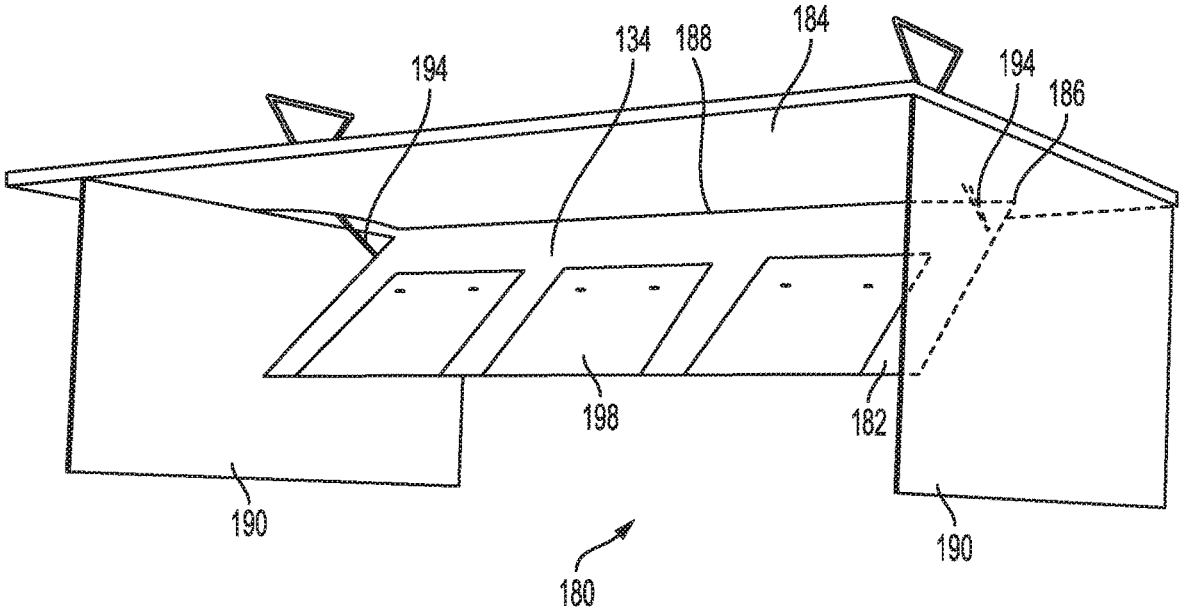
FIG. 37 is a front perspective view of the closure of FIG. 36 with the door in a partially extended position.
Figure 38:
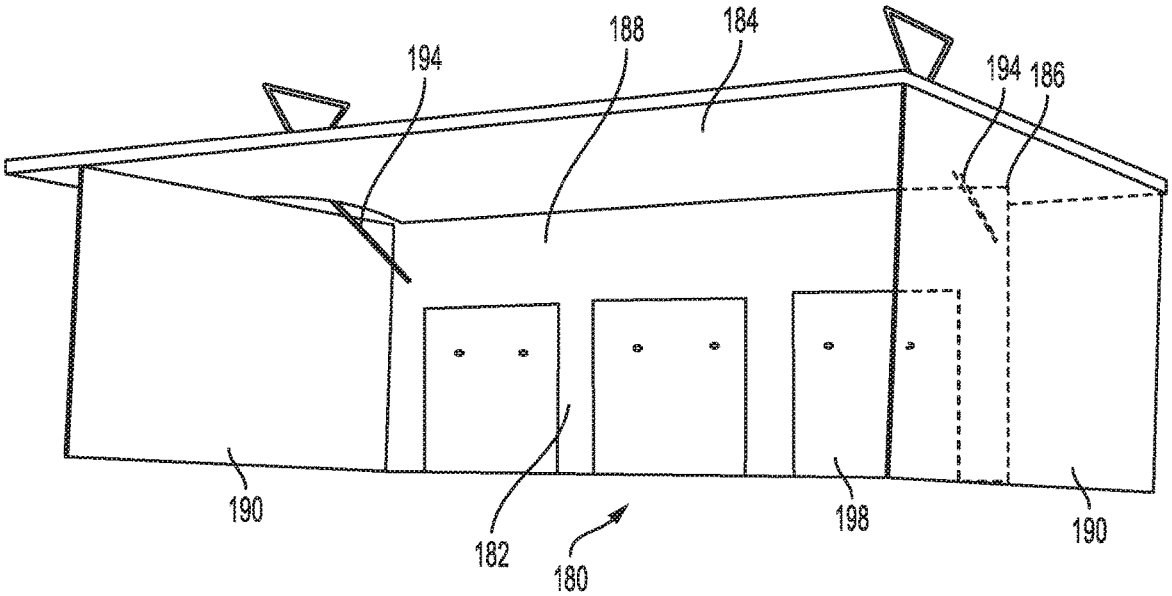
FIG. 38 is a front perspective view of the closure of FIG. 36 with the door in an extended position.

In one embodiment, a closure is configured to at least partially seal an area (e.g., between two walls, an atrium, a hallway, a large open space) to prohibit unwanted migration of heat, air, smoke, and/or fire through an area larger than a traditional doorway or hallway. In one embodiment, the closure includes a plurality of doors configured to move from a retracted position to an extended position such that the doors are configured to form a protected area (e.g., a hallway) within the large open space. In one embodiment, the closure includes an expandable material (e.g., within a hollow core of the closure) to seal any gaps between a boundary and the closure when the closure is in an extended position. In one embodiment, the closure includes a passageway configured to be at least temporarily occluded by a door such that the closure is a protective barrier to heat, air, smoke, and/or fire but people can still traverse the barrier. In other embodiments, the closure does not include a passageway and meets the requirements of ASTM-E119. Turning now to FIGS. 36-39, a closure, generally designated 180, is shown. In one embodiment, the closure 180 includes a door 182 configured to be a barrier to fire, air, and heat in a large area. For example, the closure 180 may be a swing-down barrier moveable from a retracted position (FIG. 36) to an extended position (FIG. 38).

Figure 36:
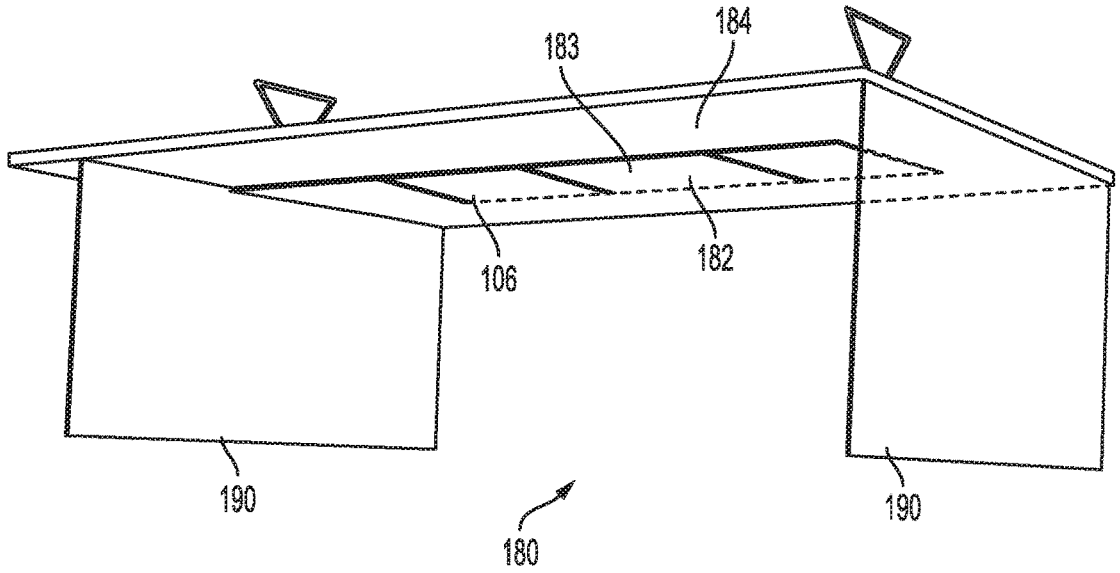
FIG. 36 is a front perspective view of a closure in accordance with an exemplary embodiment of the present invention.

In one embodiment, the door 182 is configured to be adjacent the ceiling 184 when the door is in the retracted position (FIG. 36). For example, the ceiling 184 may include a recessed area and the door 182 may be within the receiving area such that the door and ceiling present an uninterrupted surface. In one embodiment, the surface 183 of the door 182 includes the same material, and/or texture as the ceiling 184 such that the door 182 is more inconspicuous when the door is in the retracted position. In one embodiment, the door 182 includes a door surface 183 configured to be co-planar with the ceiling 184 when the door 182 is in the retracted position. In one embodiment, the door 182 includes a swing down door. For example, the door 182 may be rotatable about an axis (e.g., a hinge) such that one end of the door is coupled to the ceiling while a free end of the door is moveable with respect to the ceiling to move the door from the retracted position to the extended position. In one embodiment, the door 182 is configured to move to the extended position in response to an environmental condition (e.g., elevated temperature, fire). For example, the door 182 may automatically move to the extended position when a sensor (e.g., fire detector, hazardous gas detector) senses a condition that triggers the sensor to send a signal (e.g., an electronic signal) to a device (e.g. piston, motor, actuator) to perform an action (e.g., rotate the door, remove a restraint holding the door) to move the door to the extended position (FIG. 37). In one embodiment, the door 182 is configured to be manually activated to move the door 182 to the extended position. For example, a user may engage the door 182 (e.g., via a handle, pull chain, lever) and apply a manual force (e.g., push, pull, twist) to move the door (or allow the door to move) to the extended position.

In one embodiment, the door is configured to be adjacent a structure (e.g., a wall, another door) when the door is in the extended position to facilitate forming a protective barrier. For example, the door may include an expandable core that seals any gaps associated with the door (e.g., between the door and the structure) when the door is in the extended position. In one embodiment, a top 188 of the door 182 is configured to be coupled to the ceiling 184 such that the top 188 of the door is adjacent or near the ceiling 184 when the door is in the extended position (FIG. 38). For example, the door 182 may be movably coupled to the ceiling 184 (e.g, rotatable about a hinge coupling the top of the door to the ceiling). In one embodiment, a side 192 of the door 182 is configured to be adjacent or near a structure when the door 182 is in the extended position. For example, the door 182 may be positioned near the wall 190 when the door is in the retracted position and the door may rotate to the extended position such that the side 192 of the door is adjacent or near the wall when the door is in the extended position.

In one embodiment, the door is configured to include an expandable material within the door that expands to seal a gap between the door and an adjacent structure. In one embodiment, the door 182 includes the first surface 106, second surface 134, and internal cavity 110 as previously described. In one embodiment, the door 182 is configured to include the core 48. For example, the door 182 may include the internal cavity 110 and the internal cavity may be configured to receive the core 48. In one embodiment, the door 182 is configured to seal a gap between the door 182 and an adjacent structure at least until the core 48 is in the expanded state. For example, the door may include the seal 72 on the top 188, side, and bottom of the door 182 which prevent unwanted migration of heat, air, smoke, and/or fire up to a temperature of about 400° F. In one embodiment, the core 48 is configured to seal a gap between the door 182 and the wall 190, ceiling 184, and floor (not shown) when the core 48 is in the expanded state. For example, the core 48 may expand from the internal cavity 110 and into the gap as the core transitions to the expanded state. In one embodiment, the door 182 includes the first layer 162 and second layer 164 (not shown in FIGS. 30-33) when the core 48 is in the expanded state. For example, the core 48 may expand from the internal cavity 110 through the first perforation 140 and second perforation 142 such that the first layer 162 and second layer 164 are on the door.

Figure 39:
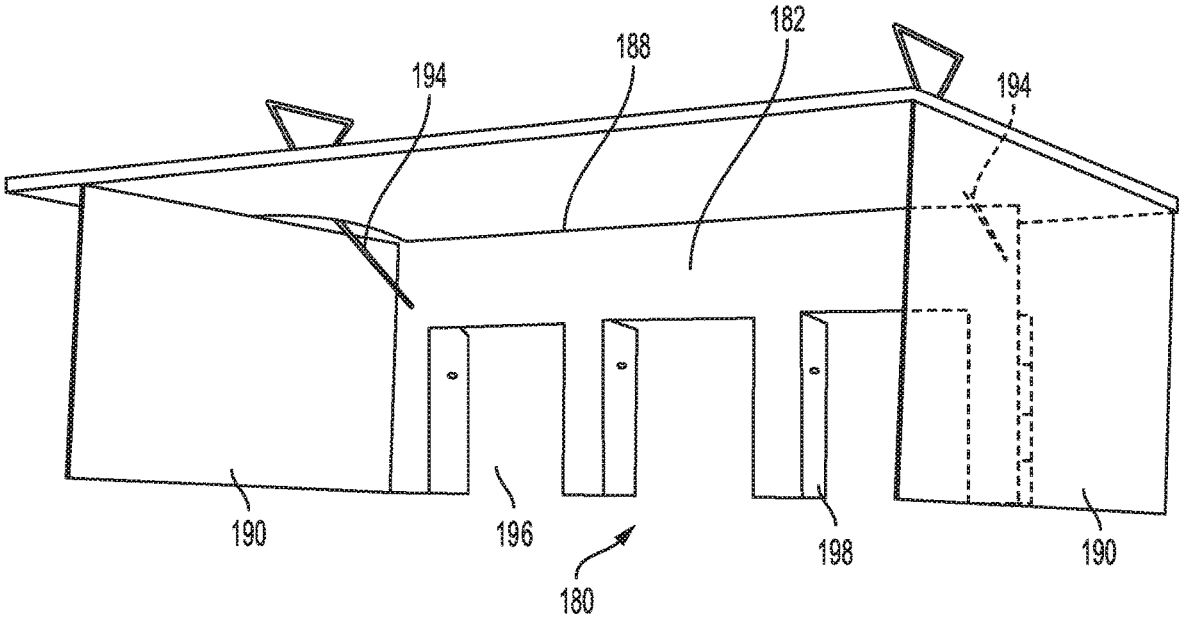
FIG. 39 is a front perspective view of the closure of FIG. 36 with the door in an extended position and passage doors in an open position.

In one embodiment, the door 182 is a protective barrier to heat, air, smoke, and/or fire and is configured to permit a person to move beyond the door when the door is in the extended position. For example, in one embodiment, the door 182 includes a passage 196 (for example, as shown in FIG. 39). In one embodiment, the passage 196 is configured to allow a person or object to move through the door 182 when the door is in the extended state. For example, the passage 196 may be an opening through the door 182 large enough for a person to pass therethrough. In one embodiment, the passage 196 includes an egress passage. In one embodiment, the door 182 includes a passage door 198 configured to at least temporarily occludes the passage 196. For example, the passage door 198 may move relative to the passage 196 (e.g., rotate, slide, translate) between a closed configuration (FIG. 38) and open configuration (FIG. 39) such that a person can move through the door 182 when the passage door 198 is in the open configuration and the passage door is a protective barrier at least partially covering the passage 196 when the passage door 198 is in the closed configuration.

In one embodiment, the core 48 is configured to form a layer on door 182 but not on the passage door 198 or the passage 196 when the core 48 is in the expanded state such that the layer 162, 164 does not occlude the passage 196 or inhibit movement of the passage door 198 between the open configuration and the closed configuration. For example, the perforations 140, 142 may be spaced from the passage 196 and passage door 198 a selected distance such that the core 48 does not extend into the passage 196 when the core is in the expanded state. In one embodiment, the passage door 198 includes an expandable material (e.g., intumescent material within a hollow cavity of the door) and is configured to form a protective barrier on a surface of the door when the material is in an expanded state. For example, the passage door 198 may include the core 48 is within an internal cavity 110 of the passage door 198 and the core may expand from within the internal cavity 110 through the perforations 140, 142, and onto one or more surfaces of the passage door 198. In one embodiment, passage door 198 includes the first layer 162 and the second layer 164 when the core 48 is in the expanded state. In one embodiment, the passage door 198 is configured to be moved between the open configuration and closed configuration when the core 48 is in the expanded state. In one embodiment, the passage door 198 is configured to at least temporarily seal a gap between the passage door 198 and the door 182 before the core is in the expanded state. For example, the passage door 198 may include the seal 72 coupled to a top, bottom, and side of the passage door 198 (e.g., via adhesive, connectors, welding).

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower", "upper", and "bottom" designate directions in the drawings to which reference is made. The words "inwardly" and "outwardly" refer to directions toward and away from, respectively, the geometric center of the closure. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

The invention claimed is:

1. A closure comprising:

a door configured to seal an opening, the door including a section with an internal cavity;

a core within a first portion of the internal cavity of the section, the core configured to expand from a relaxed state to an expanded state and provide a seal between the door and an edge of the opening when the core is in the expanded state;

a guide coupled to the edge of the opening and configured to receive a first portion of the section;

an opening header configured to receive the door when the door is in a retracted position, wherein the section is adjacent the opening header when the door is in an extended position and the core is configured to seal a header space between the door and the opening header when the core is in the expanded state; and a perimeter seal along the guide and the opening header configured as a barrier to at least one of heat, air, smoke, and fire at a temperature at which the core transitions to the expanded state, wherein the first portion of the internal cavity of the section is positioned at or near an end of the section, wherein the door is moveable with respect to the opening along the guide from the retracted position to the extended position and the first portion of the section is adjacent the guide when the door is in the extended position.

2. The closure of claim 1, wherein the section comprises a slat.

3. The closure of claim 1, further comprising a steady-state core in a second portion of the internal cavity of the section, the second portion spaced from the guide.

4. The closure of claim 3, wherein the steady-state core is non-combustible.

5. The closure of claim 1, wherein the perimeter seal along the guide is configured to seal a guide space when the door is in the extended position.

6. The closure of claim 5, wherein the perimeter seal is configured to provide the barrier to the at least one of heat, air, smoke, and fire throughout an expansion of the core from the relaxed state to the expanded state.

7. The closure of claim 5, further comprising a bottom seal on a bottom of the door configured to provide a seal between the bottom of the door and a bottom of the opening when the door is in the extended position to at least a temperature of about 400° F.

8. The closure of claim 7, wherein the perimeter seal comprises a siliconized rubber perimeter seal.

9. The closure of claim 8, wherein the siliconized rubber perimeter seal is configured to restrict infiltration of at least one of heat, air, smoke, and fire migration to a level of about 600° F.

10. The closure of claim 1, wherein the section includes a perforation such that the core expands through the perforation and into the header space.

11. The closure of claim 1, wherein the core is configured to expand in response to an increase in temperature.

12. The closure of claim 11, wherein the door is configured to be sealed to the at least one of heat, air, smoke, and fire up to at least 400° F.

13. The closure of claim 11, wherein the door is configured to be sealed to the at least one of heat, air, smoke, and fire up to at least 2000° F.

14. The closure of claim 1, wherein the section includes a section thickness and the core is configured to expand to at least 500% of the section thickness.

15. The closure of claim 1, wherein the door comprises a coiling door.

16. The closure of claim 1, wherein the door includes a plurality of additional sections, each of the additional sections having front perforations and back perforations that are configured to permit the core to migrate through the front perforations and the back perforations when the core transitions to the expanded state.

17. The closure of claim 1, further comprising a second section adjacent to and interlocking with the section with a second internal cavity and a second core within a first portion of the second internal cavity of the second section, the second core configured to expand from a relaxed state to an expanded state and provide a seal between the door and an edge of the opening when the core is in the expanded state.

18. The closure of claim 17, wherein the second section and the first section interlock in a front to back hinged configuration.

19. The closure of claim 1, wherein the core comprises first and second expanding portions disposed on opposite sides of a backing material, the first and second expanding portions aligned with a front portion of the section and a back portion of the section respectively.

20. The closure of claim 1, wherein the core is configured to initiate expansion when it reaches about 360° F.

21. The closure of claim 1, wherein the first portion of the internal cavity includes an open end.

22. The closure of claim 1, wherein the first portion of the internal cavity is configured to have a volume equal to about 10% of the total volume of the section.

23. The closure of claim 1, wherein the first portion of the internal cavity is configured to have a volume equal to about 20% of the total volume of the section.

24. The closure of claim 1, wherein the first portion of the internal cavity is configured to have a volume equal to about 30% of the total volume of the section.

25. A closure comprising:

a door configured to seal an opening, the door including a section with an internal cavity and a perforation extending between the internal cavity and a first surface of the section;

a core within the internal cavity of the section, the core configured to expand from a relaxed state to an expanded state such that the core extends through the perforation and onto the first surface of the section when the core is in the expanded state;

a guide coupled to an edge of the opening;

an opening header configured to receive the door when the door is in the retracted position; and a header space between the door and the opening header when the door is in the extended position, wherein the door is moveable with respect to the opening along the guide from a retracted position to an extended position, wherein the core is positioned at or near an end of the section, wherein the core is configured to form a seal between the section and the guide when the core is in the expanded state, and wherein the section is adjacent the opening header when the door is in the extended position and the perforation confronts the header space such that the core provides a seal between the door and the opening header when the core is in the expanded state.

* * * * *